US005931128A

United States Patent [19]

Murata et al.

[11] Patent Number: 5,931,128

[45] Date of Patent: Aug. 3, 1999

[54] VARIABLE VALVE MECHANISM AND INTERNAL COMBUSTION ENGINE WITH THE SAME

[75] Inventors: Shinichi Murata, Okazaki; Jun Isomoto, Chiryu; Hideo Nakai, Kusatsu, all of Japan

[73] Assignee: Mitsubishi Jidosha Kogyo Kabushiki Kaisha, Tokyo, Japan

[21] Appl. No.: 09/010,623

[22] Filed: Jan. 22, 1998

[30] Foreign Application Priority Data

Feb. 7, 1997 [JP] Japan ..... 9-025633

[51] Int. Cl.[6] ..... F01L 13/00

[52] U.S. Cl. ..... 123/90.17; 123/90.31

[58] Field of Search ..... 123/90.15, 90.17, 123/90.31, 90.6; 74/568 R

[56] References Cited

U.S. PATENT DOCUMENTS

| | | | |
|---|---|---|---|
| 5,592,908 | 1/1997 | Hara et al. | 123/90.17 |
| 5,704,316 | 1/1998 | Fujimoto et al. | 123/90.17 |
| 5,778,840 | 7/1998 | Murata et al. | 123/90.17 |
| 5,787,849 | 8/1998 | Mitchell | 123/90.17 |

FOREIGN PATENT DOCUMENTS

| | | |
|---|---|---|
| 47-20654 | 6/1972 | Japan . |
| A-3168309 | 7/1991 | Japan . |
| A-4183905 | 6/1992 | Japan . |
| A-610630 | 1/1994 | Japan . |

*Primary Examiner*—Weilun Lo

[57] ABSTRACT

A variable valve mechanism using a non-uniform coupling in an internal combustion engine is equipped with an axis-supporting member for supporting a cam-side rotation axis in an eccentric state. In the variable valve mechanism, the axis-supporting member is driven while taking account of friction occurring in the axis-supporting member by changing the position of the axis-supporting member so as to align with the direction of a dragging torque generated between the axis-supporting member and an intermediate rotating member or between the axis-supporting member and a rotation axis member.

10 Claims, 20 Drawing Sheets

INTAKE VALVE SIDE

EXHAUST VALVE SIDE

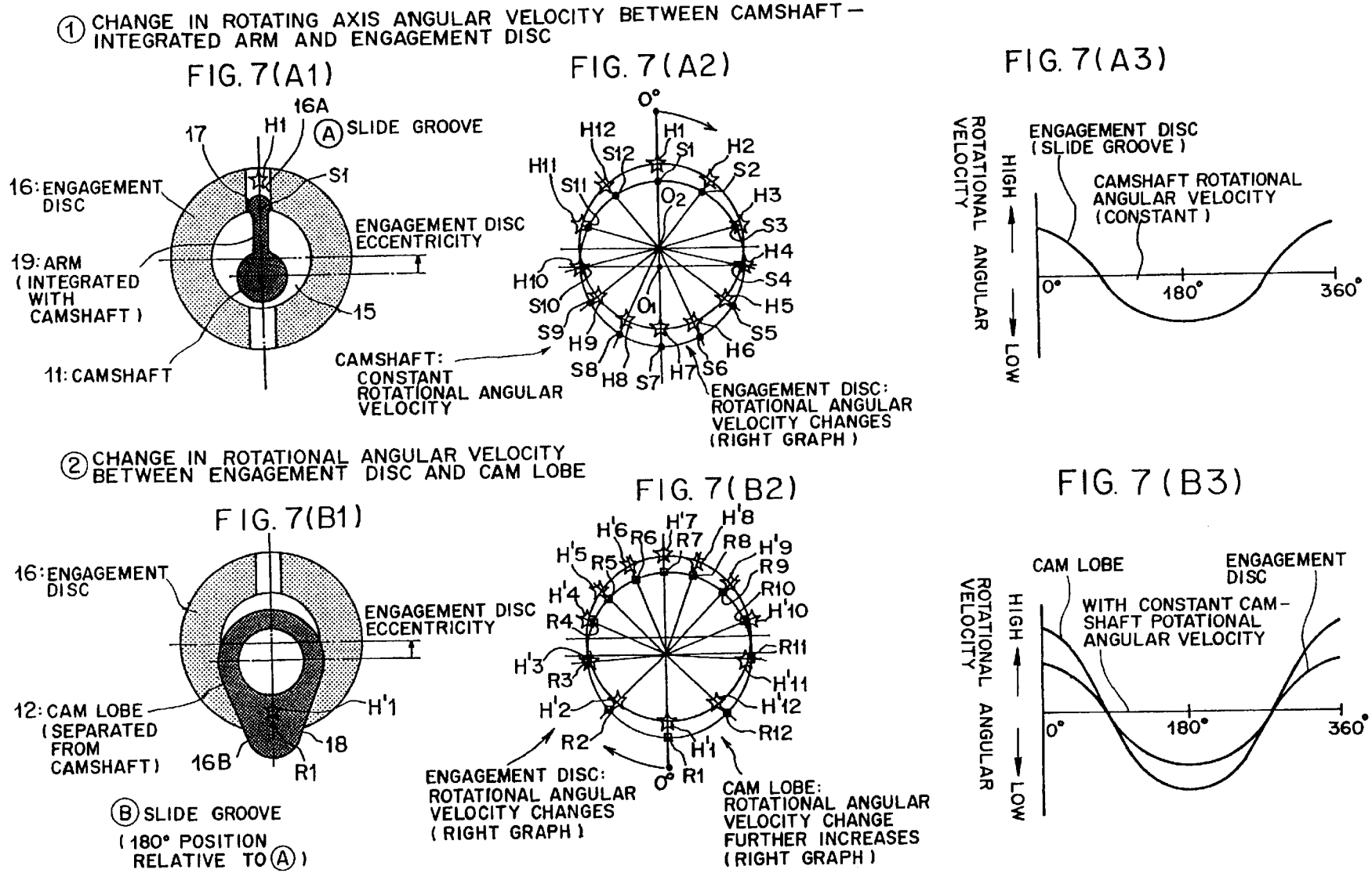
① CHANGE IN ROTATING AXIS ANGULAR VELOCITY BETWEEN CAMSHAFT – INTEGRATED ARM AND ENGAGEMENT DISC
FIG. 7(A1)
16A
Ⓐ SLIDE GROOVE
ENGAGEMENT DISC ECCENTRICITY
16: ENGAGEMENT DISC
19: ARM (INTEGRATED WITH CAMSHAFT)
11: CAMSHAFT
FIG. 7(A2)
CAMSHAFT: CONSTANT ROTATIONAL ANGULAR VELOCITY
ENGAGEMENT DISC: ROTATIONAL ANGULAR VELOCITY CHANGES (RIGHT GRAPH)
FIG. 7(A3)
ENGAGEMENT DISC (SLIDE GROOVE)
CAMSHAFT ROTATIONAL ANGULAR VELOCITY (CONSTANT)
HIGH
LOW
ROTATIONAL ANGULAR VELOCITY
② CHANGE IN ROTATIONAL ANGULAR VELOCITY BETWEEN ENGAGEMENT DISC AND CAM LOBE
FIG. 7(B1)
ENGAGEMENT DISC ECCENTRICITY
16: ENGAGEMENT DISC
12: CAM LOBE (SEPARATED FROM CAMSHAFT)
Ⓑ SLIDE GROOVE (180° POSITION RELATIVE TO Ⓐ)
FIG. 7(B2)
ENGAGEMENT DISC: ROTATIONAL ANGULAR VELOCITY CHANGES (RIGHT GRAPH)
CAM LOBE: ROTATIONAL ANGULAR VELOCITY CHANGE FURTHER INCREASES (RIGHT GRAPH)
FIG. 7(B3)
ENGAGEMENT DISC
CAM LOBE
WITH CONSTANT CAMSHAFT ROTATIONAL ANGULAR VELOCITY
HIGH
LOW
ROTATIONAL ANGULAR VELOCITY AT LOW SPEED ( ex. 2000 rpm )

AT HIGH SPEED ( ex. 7000 rpm )

CAM DRIVING TORQUE NEEDED AT HIGH SPEED
( ex 9000 r.p.m )

EXHAUST VALVE SIDE

INTAKE VALVE SIDE

VARIABLE VALVE MECHANISM AND INTERNAL COMBUSTION ENGINE WITH THE SAME

BACKGROUND OF THE INVENTION

1. Field of the Invention

This invention relates to a variable valve mechanism which opens and closes intake and/or exhaust valve(s) of an internal combustion engine at a timing corresponding to an operation state of the engine and an internal combustion engine equipped with such a variable valve mechanism and, in particular, to a variable valve mechanism utilizing a nonuniform coupling which can increase or decrease, during one rotation, the rotational speed inputted therein and output thus changed rotational speed and an internal combustion engine equipped with such a variable valve mechanism.

2. Description of Background Art

A reciprocating internal combustion engine (hereinafter referred to as engine) is equipped with intake and exhaust valves (which are hereinafter collectively referred to as engine valves or simply as valves). Since such a valve is driven in a valve lift state corresponding to the form of a cam or its rotational phase, the opening/closing timing of the valve and the opening period thereof (quantity, by unit of rotational angle of a crank, indicating a period in which the valve is open) also corresponds to the form of the cam or its rotational phase.

Meanwhile, for the intake and exhaust valves attached to the engine, optimal opening/closing timing and opening period vary depending on states of load and speed of the engine. Therefore proposed are various kinds of so-called variable valve timing apparatus (variable valve mechanisms) which can alter the opening/closing timing and opening period of such a valve.

In particular, developed is a technique in which a nonuniform coupling employing an eccentric mechanism is inserted between a cam and a camshaft, whereas the camside rotation axis is set at a position eccentric to the camshaft-side rotation axis, and the eccentric state of the cam-side rotation axis in the eccentric mechanism (i.e., axial center position of the camshaft-side rotation axis) is adjusted so that, while the camshaft makes one rotation, the cam increases or decreases its rotational speed or changes its phase, thus allowing the opening/closing timing and opening period of the valve to be regulated.

Such a technique using a nonuniform coupling is proposed, for example, in Japanese Patent Publication No. SHO 47-20654, Japanese Patent Application Laid-Open (Kokai) Nos. HEI 3-168309, HEI 4-183905, and HEI 6-10630, and the like.

In each of the variable valve mechanisms for the internal combustion engine utilizing a nonuniform coupling, such as those mentioned above, a turning force is transmitted to the cam via the nonuniform coupling. When the turning force is thus transmitted, such turning force is transmitted through complex transmission paths between the camshaft-side rotating member and the cam-side rotating member that rotate with rotating axial centers eccentric to each other in the nonuniform coupling by way of several kinds of members such as connecting members (e.g., pin elements) which transmit the turning force while radially sliding.

In particular, in a connecting member such as pin element, when the turning force is transmitted between the camshaft-side rotating member and the cam-side rotating member, the rotation driving force from the camshaft side and the valve-driving reaction force from the cam side act on rotating directions opposite to each other. Consequently, at a part provided with the connecting member, a large load synthesized by these rotation driving force and valve-driving reaction force is generated in a direction orthogonal to the axial line, whereby a sliding surface of the rotating system also bears a large load, thus increasing friction at this sliding surface.

On the other hand, between the camshaft-side rotation axis and cam-side rotation axis, a member (axis-supporting member) for holding the cam-side rotation axis in a predetermined eccentric state with respect to the camshaft-side rotation axis is necessary. In order to adjust the opening/closing timing and opening period of the valve, this axis-supporting member is required to change its position so as to alter the eccentric state (position of the eccentric axial center in general) of the cam-side rotation axis relative to the camshaft-side rotation axis.

Though such an axis-supporting member rotates or swings within a predetermined range upon adjustment of the opening/closing timing and opening period of the valve, it is basically a member on the fixed side and does not rotate together with the cam-side rotation axis or camshaft-side rotation axis. Namely, the axis-supporting member bears the above-mentioned large friction at least at its sliding surface with respect to the cam-side rotation axis.

Such friction is deemed to greatly influence, when the axis-supporting member is rotated or swung in order to adjust the valve characteristics (opening/closing timing and opening period), the response of the axis-supporting member and an actuator for rotating or swinging the axis-supporting member.

SUMMARY OF THE INVENTION

In view of the problems mentioned above, it is an object of the present invention to provide a variable valve mechanism utilizing a nonuniform coupling equipped with a member (axis-supporting member) for supporting a cam-side rotation axis in an eccentric state, in which, when driving the axis-supporting member, its driving is effected while the friction occurring between the cam-side rotation axis and the axial supporting member is taken into account, thus making it possible to attain improvement in the response of the axis-supporting member to and alleviation in burden on an actuator for the axis-supporting member; and an internal combustion engine equipped with the variable valve mechanism.

Therefore, a variable valve mechanism in accordance with the present invention comprises a first rotation axis member driven to rotate around a first rotation axis center in response to a turning force transmitted from a crankshaft of an internal combustion engine; an axis-supporting member equipped with an axis-supporting section having a second rotation axis center which is different from and in parallel to the first axis center, the axis-supporting member being disposed around an outer periphery of the first rotation axis member so as to be able to rotate or swing relative thereto such that the second rotation axis center can be displaced; an intermediate rotating member axially supported by the axis-supporting member; a first connecting member linking the intermediate rotating member to the first rotation axis member so that the intermediate rotating member can rotate together with the first rotation axis member; a second rotation axis member which rotates around the first rotation axis center and has a cam section; a second connecting member linking the second rotation axis member to the intermediate rotating member so that the second rotation axis member can rotate together with the intermediate rotating member; a valve member for setting an intake flow period or exhaust discharge period with respect to a combustion chamber of the internal combustion engine via the cam section in response to a rotational phase of the second rotation axis member; and a control member, driven by an actuator, for displacing the second rotation axis center, which is a rotation center of the axis-supporting section of the axis-supporting member, between first and second positions in response to an operation state of the internal combustion engine; wherein, when an engine speed of the internal combustion engine increases, the axis-supporting member is displaced from the first position to the second position via the control member, and wherein the direction of displacement from the first position to the second position aligns with a dragging torque occurring between the intermediate rotating member and axis-supporting member or between the axis-supporting member and first rotation axis member.

As a result of such a configuration, when the engine speed of the internal combustion engine increases, the axis-supporting member is displaced from the first position to the second position via the control member. Since the direction of displacement from the first position to the second position is set so as to align with the direction of the dragging torque occurring between the intermediate rotating member and axis-supporting member or between the axis-supporting member and first rotation axis member, an optimal valve timing corresponding to the rotational speed can be rapidly achieved when the engine is accelerated, thus contributing to improvement in acceleration performances such as improvement in acceleration feeling. Also, it is advantageous in that such an excellent response to acceleration can be realized by an actuator having a relatively small capacity without increasing the capacity of the actuator for the control member.

Also, a variable valve mechanism in accordance with the present invention comprises a first rotation axis member driven to rotate around a first rotation axis center in response to a turning force transmitted from a crankshaft of an internal combustion engine; an axis-supporting member equipped with an axis-supporting section having a second rotation axis center which is different from and in parallel to the first axis center, the axis-supporting member being disposed around an outer periphery of the first rotation axis member so as to be able to rotate or swing relative thereto such that the second rotation axis center can be displaced; an intermediate rotating member axially supported by the axis-supporting member; a first connecting member linking the intermediate rotating member to the first rotation axis member so that the intermediate rotating member can rotate together with the first rotation axis member; a second rotation axis member which rotates around the first rotation axis center and has a cam section; a second connecting member linking the second rotation axis member to the intermediate rotating member so that the second rotation axis member can rotate together with the intermediate rotating member; a valve member for setting an intake flow period or exhaust discharge period with respect to a combustion chamber of the internal combustion engine via the cam section in response to a rotational phase of the second rotation axis member; and a control member, driven by an actuator, for displacing the second rotation axis center, which is a rotation center of the axis-supporting section of the axis-supporting member, between first and second positions in response to an operation state of the internal combustion engine; wherein, when an engine speed of the internal combustion engine increases, the axis-supporting member is displaced from the first position to the second position via the control member, and wherein the direction of displacement from the first position to the second position is set opposite to a dragging torque occurring between the intermediate rotating member and axis-supporting member or between the axis-supporting member and first rotation axis member.

As a result of such a configuration, when the engine speed of the internal combustion engine increases, the axis-supporting member is displaced from the first position to the second position via the control member. Since the direction of displacement from the first position to the second position is set opposite to the direction of the dragging torque occurring between the intermediate rotating member and axis-supporting member or between the axis-supporting member and first rotation axis member, an optimal valve timing corresponding to the rotational speed can be rapidly achieved when the engine is decelerated, thus contributing to improvement in engine performances such as improvement in deceleration feeling in the engine and improvement in upshifting feeling upon acceleration in the case of the engine equipped with a transmission. Also, it is advantageous in that such an excellent response to acceleration can be realized by an actuator having a relatively small capacity without increasing the capacity of the actuator for the control member.

An internal combustion engine equipped with a variable valve mechanism in accordance with the present invention is an internal combustion engine in which variable valve mechanisms are respectively disposed on intake and exhaust sides thereof, each of the variable valve mechanisms comprising a first rotation axis member driven to rotate around a first rotation axis center in response to a turning force transmitted from a crankshaft of the internal combustion engine; an axis-supporting member equipped with an axis-supporting section having a second rotation axis center which is different from and in parallel to the first axis center, the axis-supporting member being disposed around an outer periphery of the first rotation axis member so as to be able to rotate or swing relative thereto such that the second rotation axis center can be displaced; an intermediate rotating member axially supported by the axis-supporting member; a first connecting member linking the intermediate rotating member to the first rotation axis member so that the intermediate rotating member can rotate together with the first rotation axis member; a second rotation axis member which rotates around the first rotation axis center and has a cam section; a second connecting member linking the second rotation axis member to the intermediate rotating member so that the second rotation axis member can rotate together with the intermediate rotating member; a valve member for setting an intake flow period or exhaust discharge period with respect to a combustion chamber of the internal combustion engine via the cam section in response to a rotational phase of the second rotation axis member; a control member for displacing the second rotation axis center, which is a rotation center of the axis-supporting section of the axis-supporting member, between first and second positions in response to an operation state of the internal combustion engine; and an actuator for driving directly or indirectly via a transmission mechanism the axis-supporting member provided for the variable valve mechanism on the intake side or the axis-supporting member provided for the variable valve mechanism on the exhaust side; wherein, when an engine speed of the internal combustion engine increases, the axis-supporting member on the intake side and the axis-supporting member on the exhaust side are displaced from the first position to the second position via the actuator, and wherein each of the direction of displacement from the first position to the second position of the axis-supporting member on the intake side and the direction of displacement from the first position to the second position of the axis-supporting member on the exhaust side is set to align with or opposite to a dragging torque occurring between the intermediate rotating member and axis-supporting member or between the axis-supporting member and first rotation axis member.

As a result of such a configuration, when the engine speed of the internal combustion engine increases, the axis-supporting member on the intake side and the axis-supporting member on the exhaust side are displaced from the first position to the second position via the actuator. Since each of the direction of displacement of the axis-supporting member on the intake side from the first position to the second position and the direction of displacement of the axis-supporting member on the exhaust side from the first position to the second position is set to align with or opposite to the direction of the dragging torque occurring between the intermediate rotating member and axis-supporting member or between the axis-supporting member and first rotation axis member, an optimal valve timing corresponding to the rotational speed can be rapidly achieved when the engine is accelerated or decelerated, thus contributing to improvement in acceleration performances such as acceleration feeling or improvement in deceleration performances such as improvement in deceleration feeling. Also, it is advantageous in that such an excellent response to acceleration can be realized by an actuator having a relatively small capacity without increasing the capacity of the actuator for the control member.

Also, an internal combustion engine equipped with a variable valve mechanism in accordance with the present invention is an internal combustion engine in which variable valve mechanisms are respectively disposed on intake and exhaust sides thereof, each of the variable valve mechanisms comprising a first rotation axis member driven to rotate around a first rotation axis center in response to a turning force transmitted from a crankshaft of the internal combustion engine; an axis-supporting member equipped with an axis-supporting section having a second rotation axis center which is different from and in parallel to the first axis center, the axis-supporting member being disposed around an outer periphery of the first rotation axis member so as to be able to rotate or swing relative thereto such that the second rotation axis center can be displaced; an intermediate rotating member axially supported by the axis-supporting member; a first connecting member linking the intermediate rotating member to the first rotation axis member so that the intermediate rotating member can rotate together with the first rotation axis member; a second rotation axis member which rotates around the first rotation axis center and has a cam section; a second connecting member linking the second rotation axis member to the intermediate rotating member so that the second rotation axis member can rotate together with the intermediate rotating member; a valve member for setting an intake flow period or exhaust discharge period with respect to a combustion chamber of the internal combustion engine via the cam section in response to a rotational phase of the second rotation axis member; a control member for displacing the second rotation axis center, which is a rotation center of the axis-supporting section of the axis-supporting member, between first and second positions in response to an operation state of the internal combustion engine; and an actuator for driving directly or indirectly via a transmission mechanism the axis-supporting member provided for the variable valve mechanism on the intake side or the axis-supporting member provided for the variable valve mechanism on the exhaust side; wherein, when an engine speed of the internal combustion engine increases, the axis-supporting member on the intake side and the axis-supporting member on the exhaust side are displaced from the first position to the second position via the actuator, and wherein one of the direction of displacement from the first position to the second position of the axis-supporting member on the intake side and the direction of displacement from the first position to the second position of the axis-supporting member on the exhaust side is set to align with a dragging torque occurring between the intermediate rotating member and axis-supporting member or between the axis-supporting member and first rotation axis member, whereas the other is set opposite to the dragging torque.

As a result of such a configuration, when the engine speed of the internal combustion engine increases, the axis-supporting member on the intake side and the axis-supporting member on the exhaust side are displaced from the first position to the second position via the actuator. Since one of the direction of displacement of the axis-supporting member on the intake side from the first position to the second position and the direction of displacement of the axis-supporting member on the exhaust side from the first position to the second position is set to align with the direction of the dragging torque occurring between the intermediate rotating member and axis-supporting member or between the axis-supporting member and first rotation axis member, whereas the other is set opposite to the dragging torque direction, the dragging torques on the intake side and exhaust side cancel each other. Accordingly, changing the valve timing on the acceleration side of the engine and changing the valve timing on the deceleration side can be effected with substantially the same response without being influenced by the dragging torque, whereby the setting for valve timing control can be performed easily.

BRIEF DESCRIPTION OF THE DRAWINGS

FIGS. 7(A1) to 7(A3) and FIGS. 7(B1) to 7(B3) are views showing operation principles of the nonuniform speed mechanism in the variable valve mechanism in accordance with the first embodiment of the present invention, wherein FIGS. 7(A1) to 7(A3) show relationships between rotational phases of a first rotation axis member (camshaft) and an intermediate rotating member (engagement disc), whereas FIGS. 7(B1) to 7(B3) show relationships between rotational phases of the intermediate rotating member (engagement disc) and a second rotation axis member (cam lobe);

DESCRIPTION OF THE PREFERRED EMBODIMENTS

In the following, embodiments of the present invention will be explained with reference to the accompanying drawings.

Figure 18A:
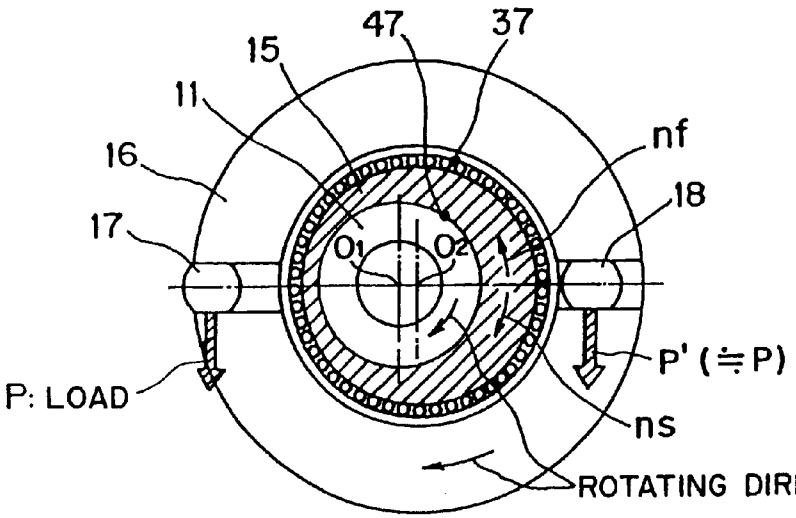
FIGS. 18(A) and 18(B) are schematic sectional views for explaining operation settings of main parts of nonuniform couplings in the variable valve mechanism in accordance with a second embodiment of the present invention, respectively illustrating the one installed on the intake side and the one installed on the exhaust side.
Figure 18B:
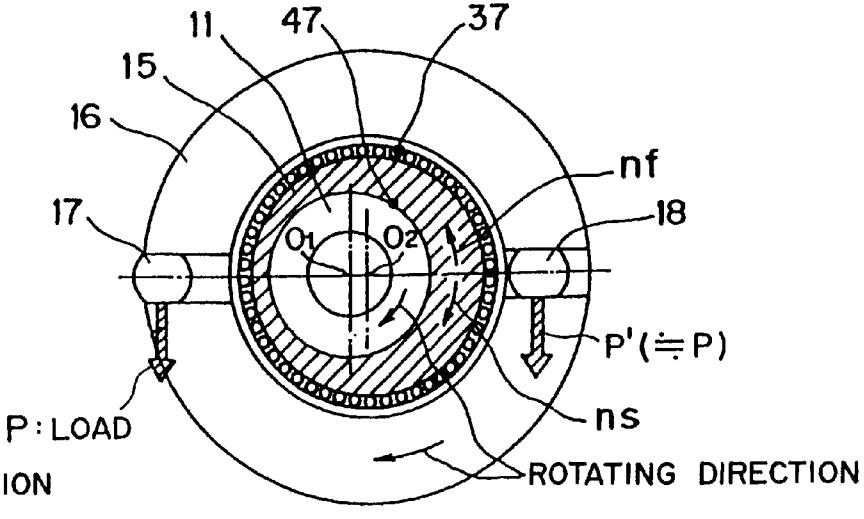
Figure 19:
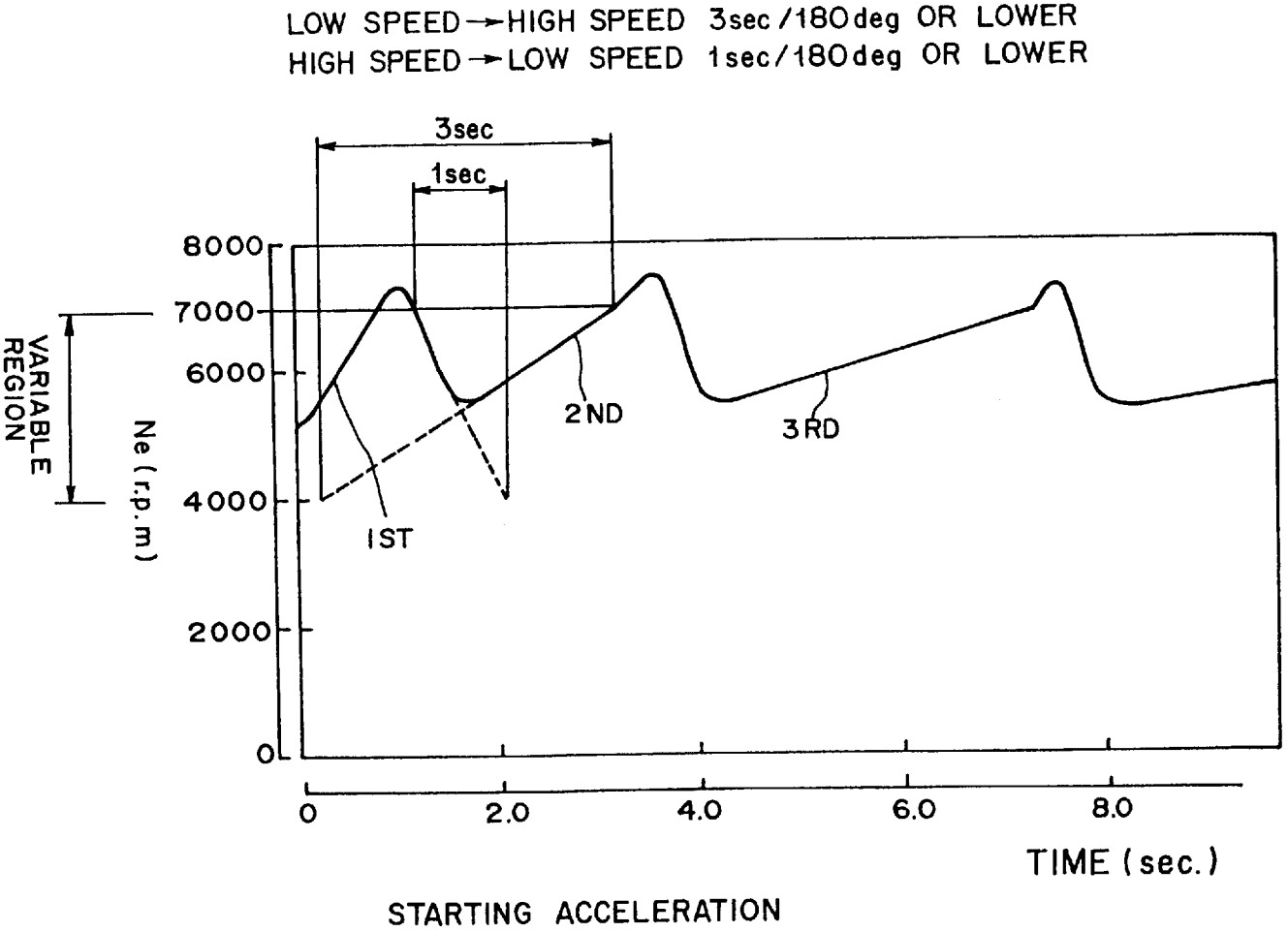
FIG. 19 is a characteristic view for explaining an effect of the operation setting in the variable valve mechanism in accordance with the second embodiment of the present invention.

FIGS. 1 to 17 show a variable valve mechanism and an internal combustion engine equipped with the variable valve mechanism in accordance with a first embodiment of the present invention; FIGS. 18 and 19 show the variable valve mechanism in accordance with a second embodiment of the present invention; FIG. 20 shows the variable valve mechanism in accordance with a third embodiment of the present invention; and FIG. 21 shows the variable valve mechanism in accordance with a fourth embodiment of the present invention.

Initially, the first embodiment will be explained.

The internal combustion engine in accordance with this embodiment is a reciprocating internal combustion engine, and the variable valve mechanism in accordance with this embodiment is disposed so as to drive an intake valve or exhaust valve (collectively referred to as engine valve or simply as valve) placed above a cylinder.

Figure 2:
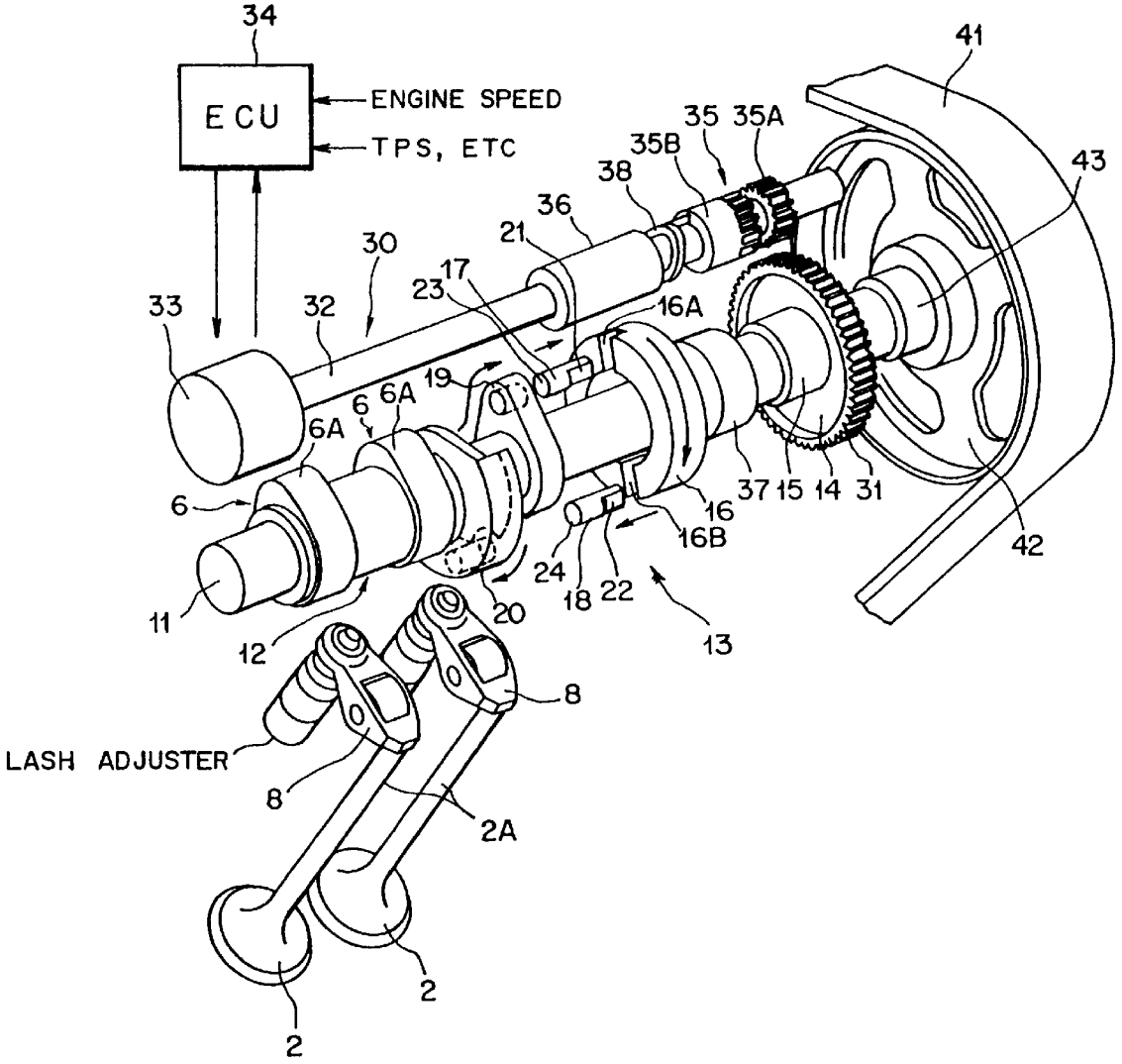
FIG. 2 is a perspective view of the variable valve mechanism in accordance with the first embodiment of the present invention.
Figure 3:
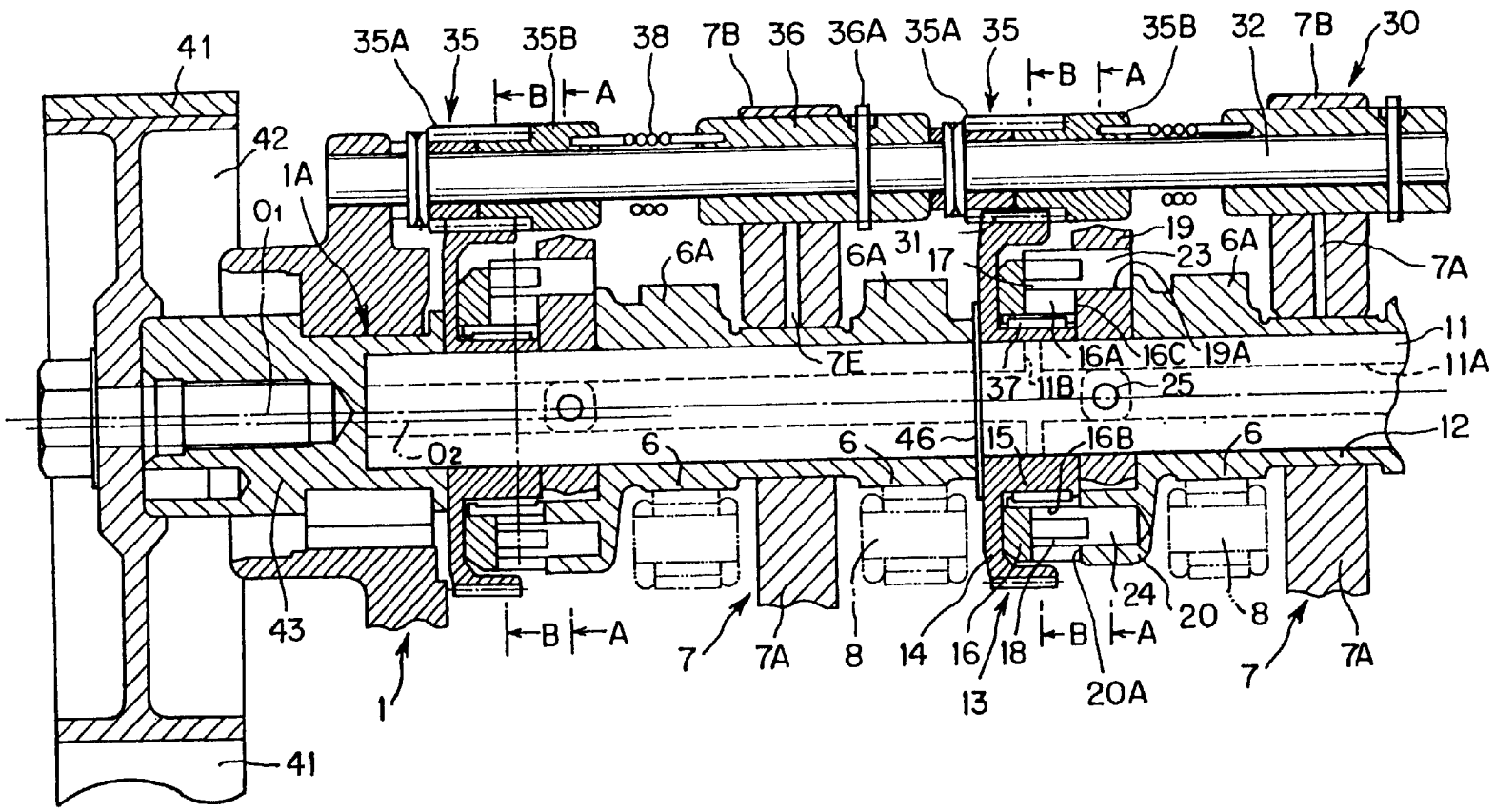
FIG. 3 is a sectional view showing main parts of the variable valve mechanism in accordance with the first embodiment of the present invention.
Figure 4:
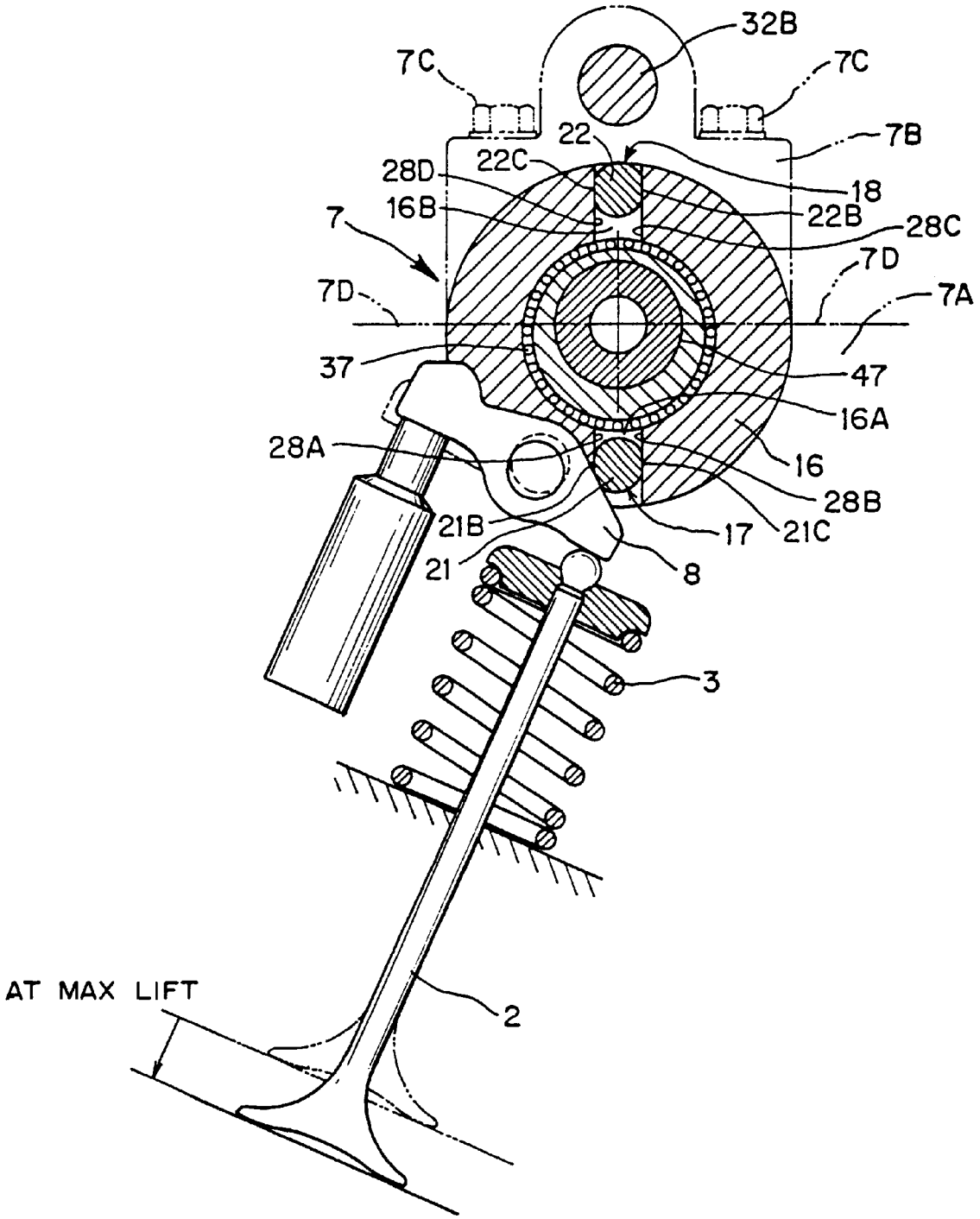
FIG. 4 is a schematic sectional view showing an arrangement of main parts of the nonuniform coupling in the variable valve mechanism in accordance with the first embodiment of the present invention.

FIGS. 2, 3, and 4 are respectively a perspective view, a sectional view, and a schematic configurational view (schematic view observed from an axial end face) each showing main parts of the variable valve mechanism. As shown in FIGS. 2 and 3, a cylinder head 1 is equipped with a valve (valve member) 2 for opening and closing an intake port or exhaust port which is not depicted. A stem end portion 2A of the valve 2 is provided with a valve spring 3 (see FIG. 4) for biasing the valve 2 toward its closing side.

Further, a rocker arm 8 abuts to the stem end portion 2A of the valve 2, whereas a cam 6 abuts to the rocker arm 8. A protruded portion (cam crest portion) 6A of the cam 6 drives the valve 2 toward its opening direction against the bias force of the valve spring 3. The variable valve mechanism is provided in order to pivot such cam 6.

As shown in FIGS. 2 and 3, the variable valve mechanism comprises a cam shaft (first rotation axis member) 11 which is driven to rotate together with a crankshaft (not depicted) of the engine via belt (timing belt) 41 and a pulley 42, and a cam lobe (second rotation axis member) 12 disposed around the outer periphery of the camshaft 11, the cam (cam section) 6 projects from the outer periphery of the cam lobe 12. Here, the outer periphery of the cam lobe 12 is axially supported in a rotatable fashion by a bearing section 7 on the cylinder head 1 side.

The camshaft 11 is supported by the bearing section 7 via the cam lobe 12, while an end portion of the camshaft 11 is axially supported by a bearing section 1A of the cylinder head 1 via an end member 43 connected onto the same axial line. Since the pulley 42 is attached to such end member 43, the latter incorporating the pulley 42 can be referred to as an input section.

As shown in FIGS. 3 and 4, the bearing section 7, which is configured so as to be separable into two parts, comprises a bearing lower half 7A formed in the cylinder head 1, a bearing cap 7B joining the bearing lower half 7A from thereabove, and a bolt 7C for connecting the bearing cap 7B to the bearing lower half 7A.

Also, as shown in FIG. 4, a joining surface 7D between the bearing lower half 7A and the bearing cap 7B is set substantially horizontal so as to become orthogonal to the non-depicted axial line of the cylinder, whereby the bolt 7C fastened substantially in the vertical direction (upward/downward direction) in FIGS. 3 and 4 firmly connects the bearing lower half 7A and the bearing cap 7B together in the vertical direction.

Disposed between the camshaft 11 and the cam lobe 12 is a nonuniform coupling 13.

This variable valve mechanism is suitable for a multi-cylinder engine. When it is applied to a multi-cylinder engine, the cam lobe 12 and the nonuniform coupling 13 are provided for each cylinder. Explained herein as an example is a case where the variable valve mechanism is applied to a straight four-cylinder engine.

The nonuniform coupling 13 comprises a control disc (axis-supporting member) 14 pivotally supported by the outer periphery of the camshaft 11; an eccentric section (axis-supporting section) 15 integrally formed with the control disc 14; an engagement disc (intermediate rotating member) 16 disposed around the outer periphery of the eccentric section 15; and a first slider member (first connecting member) 17 and a second slider member (second connecting member) 18 which are connected to the engagement disc 16.

As shown in FIG. 2, the eccentric section 15 has a rotation center $O_2$ at a position eccentric to a rotation center (first rotation center axis line) $O_1$ of the camshaft 11, and the engagement disc 16 rotates around the center (second rotation center axis line) $O_2$ of the eccentric section 15.

As shown in FIG. 2, the first slider member 17 and the second slider member 18 respectively have slider main sections 21 and 22 at their tip portions, and drive pin sections 23 and 24 on the other end side.

As shown in FIG. 3, one surface of the engagement disc 16 is radially formed with a slider groove 16A in which the slider main section 21 of the first slider member 17 is slidably fitted, and a slider groove 16B in which the slider main section 22 of the second slider member 18 is slidably fitted. Here, the two slider grooves 16A and 16B are disposed on the same diameter such that their phases of rotation shift from each other by 180°.

The camshaft 11 is provided with a drive arm 19; the cam lobe 12 is provided with an arm section 20; the drive arm 19 has a hole section 19A into which the drive pin section 23 of the first slider member 17 is rotatably fitted; and the arm section 20 has a hole section 20A into which the drive pin section 24 of the second slider member 18 is rotatably fitted.

In the space between the cam lobe 12 and control disc 14 excluding the arm section 20, the drive arm 19 is disposed so as to radially project from the camshaft 11 and is connected by a lock pin 25 to the camshaft 11 so as to rotate together therewith. On the other hand, the arm section 20 is integrally formed with the cam lobe 12 so that the end portion of the latter radially and axially projects to a position approximating one side face of the engagement disc 16.

As shown in FIG. 4, a turning force is transmitted between outer planes 21B, 21C of the slider main section 21 and inner wall planes 28A, 28B of the groove 16A between the slider main section 21 and the groove 16A; whereas a turning force is transmitted between inner wall planes 28C, 28D of the groove 16B and outer planes 22B, 22C of the slider main section 22 between the groove 16B and the slider main section 22.

When rotation is thus transmitted, since the engagement disc 16 is eccentric, while the engagement disc 16 repeatedly advances and retards relative to the camshaft 11, and while the cam lobe 12 repeatedly advances and retards relative to the engagement disc 16, the cam lobe 12 rotates at a speed different from that of the camshaft 11.

For example, FIGS. 7(A1) to 7(A3) and FIGS. 7(B1) to 7(B3) are views illustrating that the cam lobe 12 rotates at a speed different from the camshaft 11, wherein FIGS. 7(A1) to 7(A3) show a change in rotational speed of the engagement disc 16 relative to the camshaft 11, whereas FIGS. 7(B1) to 7(B3) show a change in rotational speed of the cam lobe 12 relative to the engagement disc 16.

As shown in FIG. 7(A1), it is assumed that the rotation center (second rotation center axis line) $O_2$ of the engagement disc 16 is upwardly eccentric to the rotation center (first rotation center axis line) $O_1$ of the camshaft 11, and that the camshaft 11 rotates clockwise with the state where the slider groove 16A and the first slider member 17 are positioned in the direction of this eccentricity being defined as a rotation reference position.

In FIGS. 7(A1) and 7(A2), S1 indicates the position of a reference point on the camshaft 11 side (e.g., center point of the first slider member 17) in the rotation reference position, whereas H1 indicates a reference point on the engagement disc 16 side (e.g., reference point of the slider groove 16A) in the rotation reference position.

Also, S2 to S12 respectively indicate positions attained when the reference point on the camshaft 11 side (center point of the first slider member 17) is rotated by increments of a predetermined angle (30° here), whereas H2 to H12 respectively show points of the reference point on the engagement disc 16 side (reference point of the slider groove 16A) rotating in response to the reference point positions S2 to S12 on the camshaft 11 side.

Here, the reference point on the camshaft 11 side is rotated around the first rotation center axis line $O_1$, whereas the reference point on the engagement disc 16 side is rotated around the second rotation center axis line $O_2$.

As shown in FIG. 7(A2), when the reference point on the camshaft 11 side (center point of the first slider member 17) rotates from S1 to S2 by 30° ($\angle S1 \cdot O_1 \cdot S2$), the reference point on the engagement disc 16 side (reference point of the slider groove 16A) rotates from H1 to H2 by an angle of $\angle H1 \cdot O_2 \cdot H2$, whereby it rotates by a rotational angle greater than that on the camshaft 11 side ($\angle H1 \cdot O_2 \cdot H2 > \angle ZS1 \cdot O_1 \cdot S2$). Namely, the engagement disc 16 side rotates at a higher speed than the camshaft 11 side.

Then, when the camshaft 11 side rotates from S2 to S3 by 30° ($\angle S2 \cdot O_1 \cdot S3$), the engagement disc 16 side rotates from H2 to H3 by an angle of $\angle H2 \cdot O_2 \cdot H3$, whereby it rotates by a rotational angle slightly greater than that on the camshaft 11 side ($\angle H2 \cdot O_2 \cdot H3 > \angle S2 \cdot O_1 \cdot S3$) here. Namely, during this period, the engagement disc 16 side rotates at a slightly higher speed than the camshaft 11 side.

Subsequently, when the camshaft 11 side rotates from S3 to S4 by 30° ($\angle S3 \cdot O_1 \cdot S4$), the engagement disc 16 side rotates from H3 to H4 by an angle of $\angle H3 \cdot O_2 \cdot H4$, whereby it rotates by a rotational angle substantially the same as that on the camshaft 11 side ($\angle H3 \cdot O_2 \cdot H4 \cong \angle S3 \cdot O_1 \cdot S4$) here. Namely, during this period, the engagement disc 16 side rotates at substantially the same speed as the camshaft 11 side.

Then, when the camshaft 11 side rotates from S4 to S5 by 30° ($\angle S4 \cdot O_1 \cdot S5$), the engagement disc 16 side rotates from H4 to H5 by an angle of $\angle H4 \cdot O_2 \cdot H5$, whereby it rotates by a rotational angle substantially the same as that on the camshaft 11 side ($\phi H4 \cdot O_2 \cdot H5 \cong \angle S4 \cdot O_1 \cdot S5$) here as well. Namely, during this period, the engagement disc 16 side rotates at substantially the same speed as the camshaft 11 side.

Then, when the camshaft 11 side rotates from S5 to S6 by 30° ($\angle S5 \cdot O_1 \cdot S6$), the engagement disc 16 side rotates from H5 to H6 by an angle of $\angle H5 \cdot O_2 \cdot H6$, whereby it rotates by a rotational angle slightly smaller than that on the camshaft 11 side ($\angle H5 \cdot O_2 \cdot H6 < \angle S5 \cdot O_1 \cdot S6$) here. Namely, during this period, the engagement disc 16 side rotates at a slightly lower speed than the camshaft 11 side.

Further, when the camshaft 11 side rotates from S6 to S7 by 30° ($\angle S6 \cdot O_1 \cdot S7$), the engagement disc 16 side rotates from H6 to H7 by an angle of $\angle H6 \cdot O_2 \cdot H7$, whereby it rotates by a rotational angle smaller than that on the camshaft 11 side ($\angle H6 \cdot O_2 \cdot H7 < \angle S6 \cdot O_1 \cdot S7$) here. Namely, during this period, the engagement disc 16 side rotates at a lower speed than the camshaft 11 side.

Thus, the engagement disc 16 side rotates at the highest speed at the position H1 relative to the camshaft 11 side; and then, while the camshaft 11 side successively rotates from S1 to S2, S3, S4, S5, S6, and S7, the cam disc 16 side gradually reduces its speed relative to the camshaft 11 side as it successively rotates from H1 to H2, H3, H4, H5, H6, and H7. During this period, the engagement disc 16 side attains a speed substantially the same as that of the camshaft 11 side in the proximity of the region between points H3 to H5, and thereafter the engagement disc 16 side becomes slower than the camshaft 11 side, while rotating at the lowest speed at the position H7 relative to the camshaft 11 side.

Then, while the camshaft 11 side successively rotates from S7 to S8, S9, S10, S11, S12, and S1, the cam disc 16 side gradually increases its speed relative to the camshaft 11 side as it successively rotates from H7 to H8, H9, H10, H11, H12, and H1. During this period, the engagement disc 16 side attains a speed substantially the same as that of the camshaft 11 side in the proximity of the region between points H9 and H10, and thereafter the engagement disc 16 side becomes faster than the camshaft 11 side, while rotating at the highest speed at the position H1 relative to the camshaft 11 side.

FIG. 7(A3) shows the rotational speed on the engagement disc 16 side relative to that on the camshaft 11 side according to the rotational angle of the camshaft 11 (assumed to rotate clockwise with the position S1 being set to 0° or 360°). In FIG. 7(A3), the rotational speed of the camshaft 11 is set constant (on abscissa), and the rotational speed on the engagement disc 16 side changes with a characteristic similar to a cosine curve.

With respect to such rotation on the engagement disc 16 side, the rotational speed on the cam lobe 12 side changes as shown in FIGS. 7(B1) to 7(B3). FIGS. 7(A1) to 7(A3) respectively correspond to FIGS. 7(B1) to 7(B3).

Also, as shown in FIG. 7(B1), rotation is transmitted between the cam disc 16 side and the cam lobe 12 side through the slider groove 16B and second slider member 18 located at a position rotated by 180° relative to the first slider member 17. Accordingly, in the reference state [see FIG. 7(A1)] where the slider groove 16A and first slider member 17 are positioned in the direction in which the rotation center (second rotation center axis line) $O_2$ of the cam disc 16 is eccentric to the rotation center (first rotation axis) $O_1$ of the camshaft 11; as shown in FIG. 7(B1), the slider groove 16B and second slider member 18 are located at a position rotated from the slider groove 16A and first slider member 17 by 180° (on the lower side of the drawing), which is defined as a reference position.

In FIGS. 7(B1) and 7(B2), H'1 indicates the position of a reference point on the engagement disc 16 side (e.g., reference point of the slider groove 16B) in the rotation reference position, whereas R1 indicates a reference point on the cam lobe 12 side (e.g., center point of the second slider member 18) in the rotation reference position.

Also, H'2 to H'12 indicate second reference points (reference points of the slider groove 16B) on the engagement disc 16 side respectively corresponding to the first reference points (reference points of the slider groove 16A) H2 to H12 on the engagement disc 16 side, whereas R2 to R12 respectively show positions of the reference point on the cam lobe 12 side (center point of the second slider member 18) rotated in response to the second reference points (reference points of the slider groove 16B) H'2 to H'12 on the engagement disc 16 side.

Here, the reference point on the engagement disc 16 side is rotated around the second rotation center axis line $O_2$, whereas the reference point on the cam lobe 12 side is rotated around the first rotation center axis line $O_1$ As shown in FIGS. 7(B2) and 7(B3), the cam lobe 12 side rotates with a characteristic in which the speed characteristic on the engagement disc 16 side relative to the camshaft 11 side is further enhanced. Thus, the cam lobe 12 side rotates at the highest speed at the position R1 relative to the engagement disc 16 side; and thereafter, while the engagement disc 16 side successively rotates from H'1 to H'2, H'3, H'4, H'5, H'6, and H'7, the cam lobe 12 side gradually reduces its speed relative to the engagement disc 16 side while successively rotating from R1 to R2, R3, R4, R5, R6, and R7. During this period, the cam lobe 12 side attains substantially the same speed as the engagement disc 16 side in the proximity of the region between the positions R3 and R4, and thereafter the cam lobe 12 side becomes slower than the engagement disc 16 side, while rotating at the lowest speed at the position R7 relative to the engagement disc 16 side.

Then, while the engagement disc 16 side successively rotates from H'7 to H'8, H'9, H'10, H'11, H'12, and H'1, the cam lobe 12 side gradually increases its speed relative to the engagement disc 16 side while successively rotating from R7 to R8, R9, R10, R11, R12, and R1. During this period, the cam lobe 12 side attains substantially the same speed as the engagement disc 16 side in the proximity of the region between the positions R9 and R10, and thereafter the cam lobe 12 side becomes faster than the engagement disc 16 side, while rotating at the highest speed at the position R1 relative to the engagement disc 16 side.

FIG. 7(B3) indicates such a rotational speed characteristic on the cam lobe 12 side in response to the rotational speed characteristic on the engagement disc 16 side [characteristic similar to that shown in FIG. 7(A3)]. Here, the rotational speed on the cam lobe 12 side changes with a cosine-curve-like characteristic similar to the rotational speed on the engagement disc 16 side, while the characteristic on the engagement disc 16 side is further enhanced (i.e., amplitude is enhanced). Namely, with respect to the rotational speed on the camshaft 11 side, the rotational speed on the cam lobe 12 side changes with a characteristic similar to a cosine curve.

Figure 8C:
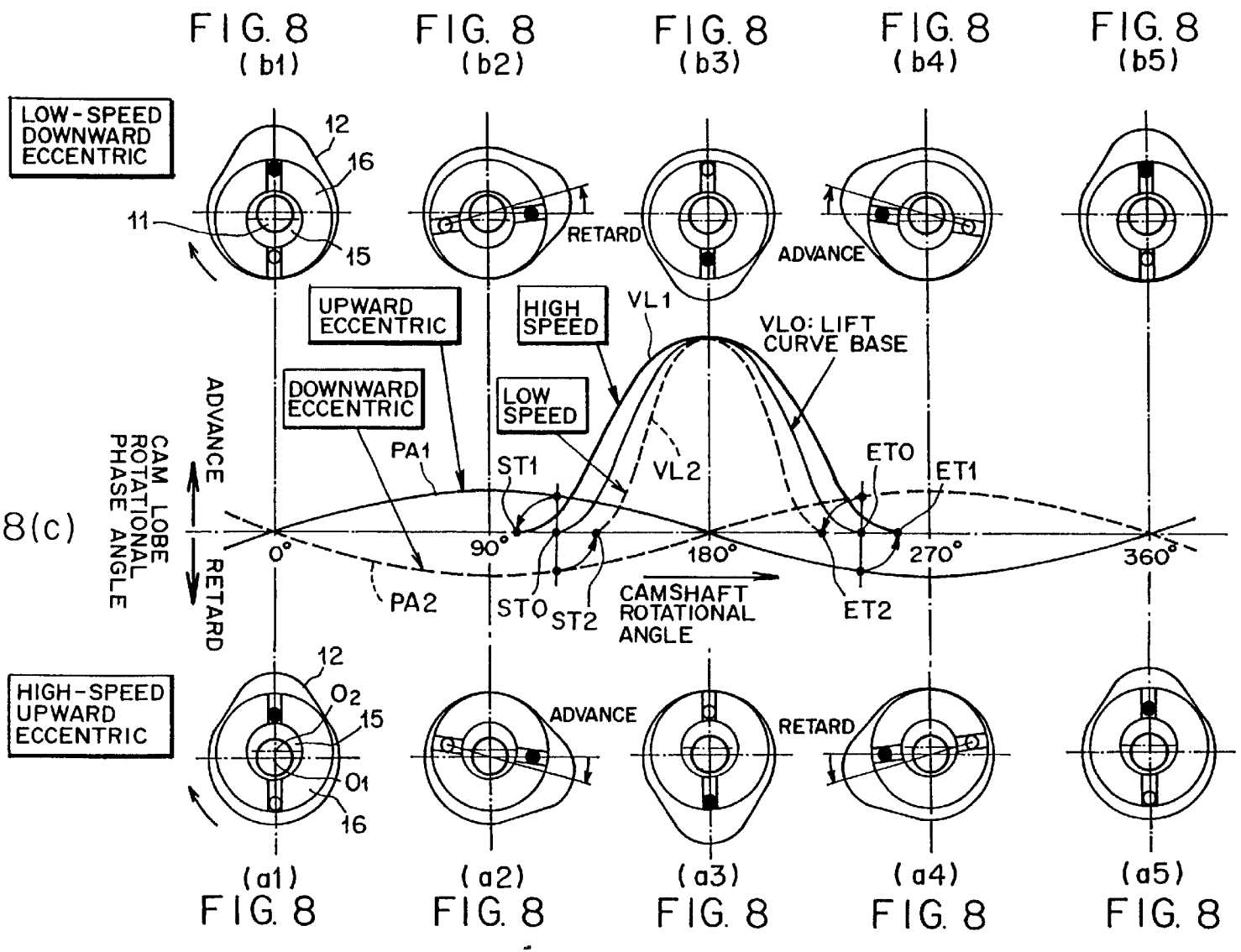
FIGS. 8(*a*1) to 8(*a*5), FIGS. 8(*b*1) to 8(*b*5), and 8(*c*) are characteristic views for explaining operation characteristics of the nonuniform speed mechanisms in the variable valve mechanism in accordance with the first embodiment of the present invention, wherein FIGS. 8(*a*1) to 8(*a*5) indicate operation states at a high speed, FIGS. 8(*b*1) to 8(*b*5) indicate operation states at a low speed, and FIG. 8(*c*) is a graph for explaining an angle of rotational phase of the second rotation axis member (cam lobe)

The rotational phase characteristic on the cam lobe 12 side relative to such rotational speed characteristic on the cam lobe 12 side (characteristic of whether the cam lobe 12 side advances or retards relative to the camshaft 11 side) is represented by curves PA1 and PA2 in the graph of FIG. 8(*c*).

Namely, as shown in FIGS. 7(A1), 7(B1), and 8(*a*1), it is assumed that the rotation center (second rotation center axis line) $O_2$ of the engagement disc 16 is upwardly eccentric to the rotation center (first rotation center axis line) $O_1$ of the cam lobe 12 (high-speed upward eccentric). Then, when the state where the slider groove 16A and the first slider member 17 are positioned above the rotation centers $O_1$ and $O_2$ while the slider groove 16B and the second slider member 18 are positioned below the rotation centers $O_1$ and $O_2$ is defined as a reference (where the camshaft rotational angle is zero), the phase characteristic on the cam lobe 12 side is represented by the curve PA1 of FIG. 8(*c*).

As indicated by the curve PA1 in FIG. 8(*c*), when the camshaft rotational angle is zero as indicated by S1, H1, H'1, and R1 in FIGS. 8(*a*1), 7(A2), and 7(B2), the cam lobe 12 side attains the same phase angle as that on the camshaft 11 side.

The rotational phase characteristic on the cam lobe 12 side corresponding to the rotational angle of the camshaft 11 thereafter, i.e., the advancing or retarding characteristic of the rotational phase on the cam lobe 12 side relative to the rotational phase of the camshaft 11 side corresponds to the value obtained when the rotational speed on the cam lobe 12 side relative to the rotational speed on the camshaft 11 side [see FIG. 7(B3)] is integrated.

Accordingly, as indicated by the curve PA1 in FIG. 8(*c*), when the camshaft 11 pivots from 0° to 90°, the cam lobe 12 side advances from the camshaft 11 side, while gradually increasing its advancing angle. When the camshaft 11 becomes 90°, the cam lobe 12 side advances farthest relative to the camshaft 11 side [see FIG. 8(*a*2)]. Thereafter, when the camshaft 11 pivots from 90° to 180°, while the cam lobe 12 side advances from the camshaft 11 side, its advancing angle gradually decreases. When the camshaft 11 becomes 180°, the cam lobe 12 side attains the same phase angle as the camshaft 11 side [see FIG. 8(*a*3)].

Further, when the camshaft 11 pivots from 180° to 270°, the cam lobe 12 side retards from the camshaft 11 side, while gradually increasing its retarding angle. When the cam-shaft 11 becomes 270°, the cam lobe 12 side retards farthest relative to the camshaft 11 side [see FIG. 8(*a*4)]. Thereafter, when the camshaft 11 pivots from 270° to 360°, while the cam lobe 12 side retards from the camshaft 11 side, its retarding angle gradually decreases. When the camshaft 11 becomes 360°, the cam lobe 12 side attains the same phase angle as the camshaft 11 side [see FIG. 8(*a*5)].

Here, when the position of the valve 2 with respect to the cam 6 is set such that valve lift is maximized at the position where the camshaft 11 is at 180°, the valve lift curve is represented by curve VL1 in FIG. 8(*c*). Here, curve VL0 in FIG. 8(*c*) indicates the lift curve characteristic (lift curve base) in the case where the cam lobe 12 side is not eccentric to the cam shaft 11 side, whereby the cam lobe 12 side always attains the same constant phase angle as that of the cam lobe 12 side.

In the lift curve characteristic represented by curve VL1, valve opening timing (opening starting time) ST1 becomes earlier than opening timing STO of the lift curve base, whereas valve closing timing (opening ending time) ET1 becomes later than closing timing ETO of the lift curve base. The valve opening timing ST1 becomes earlier than that in the lift curve base since the rotational phase angle on the cam lobe 12 side is advanced from that on the camshaft 11 side in the region where the valve starts its opening. The valve closing timing ET1 becomes later than that of the lift curve base since the rotational phase angle on the cam lobe 12 side is retarded from that on the camshaft 11 side in the region where the valve terminates its opening.

On the other hand, as shown in FIG. 8(*b*1), in the case where defined as a reference (camshaft rotational angle is zero) is a state in which the rotation center (second rotation center axis line) $O_2$ of the engagement disc 16 is downward eccentric to the rotation center (first rotation center axis line) $O_1$ of the camshaft 11 and cam lobe 12 (low-speed downward eccentric), and the slider groove 16A and first slider member 17 are positioned above the rotation centers $O_1$ and $O_2$ while the slider groove 16B and second slider member 18 are positioned below the rotation centers $O_1$ and $O_2$, the phase characteristic on the cam lobe 12 side is represented by curve PA2 in FIG. 8(*c*).

Namely, as indicated by the curve PA2 of FIG. 8(*c*), the cam lobe 12 side attains the same phase angle as that on the camshaft 11 side when the camshaft rotational angle is zero as shown in FIG. 8(*a*1). Thereafter, as the camshaft 11 pivots from 0° to 90°, the cam lobe 12 side retards from the camshaft 11 side, while gradually increasing its retarding angle. When the camshaft 11 becomes 90°, the cam lobe 12 side retards farthest from the camshaft 11 side [see FIG. 8(*b*2)]. Thereafter, while the camshaft 11 pivots from 90° to 180°, though the cam lobe 12 side is retarded from the camshaft 11 side, its retarding angle gradually decreases. When the camshaft 11 becomes 180°, the cam lobe 12 side attains the same phase angle as that on the camshaft 11 side [see FIG. 8(*b*3)].

Further, as the camshaft 11 pivots from 180° to 270°, the cam lobe 12 side advances from the camshaft 11 side, while gradually increasing its advancing angle. When the camshaft 11 becomes 270°, the cam lobe 12 side advances farthest from the camshaft 11 side [see FIG. 8(*b*4)]. Thereafter, while the camshaft pivots from 270° to 360°, though the cam lobe 12 side advances from the camshaft 11 side, its advancing angle gradually decreases. When the camshaft 11 becomes 360°, the cam lobe 12 side attains the same phase angle as that on the camshaft 11 side [see FIG. 8(*b*5)].

Thus, when the cam lobe 12 rotates with a rotational phase characteristic such as that indicated by the curve PA2 in FIG. 8(*c*), the valve lift curve is represented by curve VL2 of FIG. 8(*c*).

In the lift curve characteristic represented by curve VL2, valve opening timing (opening starting time) ST2 becomes later than the opening timing STO of the lift curve base, whereas valve closing timing (opening ending time) ET2 becomes earlier than the closing timing ETO of the lift curve base.

The valve opening timing ST2 becomes earlier than that in the lift curve base since the rotational phase angle on the cam lobe 12 side is retarded from that on the camshaft 11 side in the region where the valve starts its opening. The valve closing timing ET2 becomes earlier than that of the lift curve base since the rotational phase angle on the cam lobe 12 side is advanced from that on the camshaft 11 side in the region where the valve terminates its opening.

Thus, the valve lift curve characteristic can be changed in response to the rotation center (second rotation center axis line) $O_2$ of the engagement disc 16, i.e., eccentric position of the engagement disc 16. In the case where the valve opening timing is early while its closing timing is late, the valve opening period is elongated so as to become suitable for the high-speed rotation of the engine. In the case where the valve opening timing is late while its closing timing is early, the valve opening period is shortened so as to become suitable for the low-speed rotation of the engine.

Consequently, as shown in FIG. 8(*a*1), when the rotation center (second rotation center axis line) $O_2$ of the engagement disc 16 is located above the rotation center (first rotation center axis line) $O_1$ of the camshaft 11 (opposite to the rotational phase direction providing the valve lift top), the valve opening period is the longest, thus yielding eccentricity for high speed; whereas, as shown in FIG. 8(*b*1), when the rotation center (second rotation center axis line) $O_2$ of the engagement disc 16 is located below the rotation center (first rotation center axis line) $O_1$ of the camshaft 11 (in the rotational phase direction providing the valve lift top), the valve opening period is the shortest, thus yielding eccentricity for low speed.

When the rotation center (second rotation center axis line) $O_2$ of the engagement disc 16 is located at an intermediate position between the positions shown in FIGS. 8(*a*1) and 8(*b*1), the valve 2 is driven with a valve characteristic (valve opening timing and closing timing) corresponding to this position.

Namely, as the second rotation center axis line $O_2$ is shifted downward from the upper eccentric position shown in FIG. 8(*a*1), the valve characteristic approaches the lift curve base characteristic represented by curve VL0 from the lift curve characteristic indicated by curve VL1 (high-speed characteristic) ;and, when the second rotation center axis line $O_2$ attains substantially the same height as that of the first rotation center axis line $O_1$ (when there is no vertical deviation), the valve characteristic substantially approximates the lift curve base characteristic. As the second rotation center axis line $O_2$ is further shifted toward the lower eccentric position shown in FIG. 8(*b*1), the valve characteristic approaches the lift curve characteristic (low-speed characteristic) represented by curve VL2 from the lift curve characteristic indicated by curve VL0.

Accordingly, when the position of the second rotation center axis line $O_2$ is adjusted continuously or stepwise in response to an engine operation state such as engine speed (rotational speed), the valve 2 can always be driven with a characteristic appropriate for the engine operation state.

In order to adjust the position of the rotation center (second rotation center axis line) $O_2$ of the engagement disc 16, it is sufficient to rotate the eccentric section 15 supporting the engagement disc 16 in an eccentric state. Accordingly, this mechanism is provided with an eccentric position adjusting means (control member) 30 for rotating the control disc 14 having the eccentric section 15 so as to rotate the eccentric position of the eccentric section 15.

As shown in FIGS. 2 and 3, the eccentric position adjusting mechanism 30 comprises an eccentricity control gear 31 formed around the outer periphery of the control disc 14, a gear shaft (control shaft) 32 having a control gear 35 in mesh with the eccentricity control gear 31, and an actuator 33 for driving the control shaft 32 to rotate; and controls operations via an ECU 34.

Namely, as shown in FIG. 2, detected information (engine speed information) from an engine speed sensor (not depicted), detected information (TPS information) from a throttle position sensor, detected information (AFS information) from an airflow sensor (not depicted), and the like are fed into the ECU 34. Based on these kinds of information, the motor control in the eccentric position adjusting mechanism 30 is effected in response to the rotational speed and load state of the engine.

For example, when the engine is operated at a high speed or under a high load, the rotational phase of the control disc 14 is adjusted so as to attain a valve lift characteristic such as that of the curve VL1 in FIG. 8(*c*), thus yielding a long valve opening period. On the other hand, when the engine is operated at a low speed or under a low load, the rotational phase of the control disc 14 is adjusted so as to attain a valve lift characteristic such as that of the curve VL2 in FIG. 8(*c*), thus yielding a short valve opening period. In general, in response to the speed and load of the engine, the rotational state of the control disc 14 is adjusted so as to attain an intermediate valve lift characteristic between the curves VL1 and VL2 in FIG. 8(*c*).

Meanwhile, the control gear 35 attached to the control shaft 32 is a scissors gear composed of two gears 35A and 35B, in which one gear 35A is secured to the control shaft 32, whereas the other gear 35B is rotatably attached to the control shaft 32. Namely, the gear 35B is disposed so as to abut to the gear 35A and is installed so as to receive a bias force toward the rotating direction from a torsion spring 38 disposed between the gear 35B and a journal 36 secured to the outer periphery of the control shaft 32, whereby the eccentricity control gear 31 on the control disc 14 side and the control gear 35 mesh with each other by means of both gears 35A and 35B without rattle.

When installing the eccentric position adjusting mechanism 30, the gears 35A and 35B are caused to mesh with the eccentricity control gear 31 on the side of the control disc 14 around the outer periphery of the camshaft 11 that has already been installed. Then, the journal 36 is disposed at a predetermined axial position while being rotated with respect to the control shaft 32, thereby imparting bias forces to the gear 35B in axial and rotational directions. Thereafter, the journal 36 is fastened by a rotation-stopper pin 36A so as to be rotated together with the control shaft 32.

Figure 9:
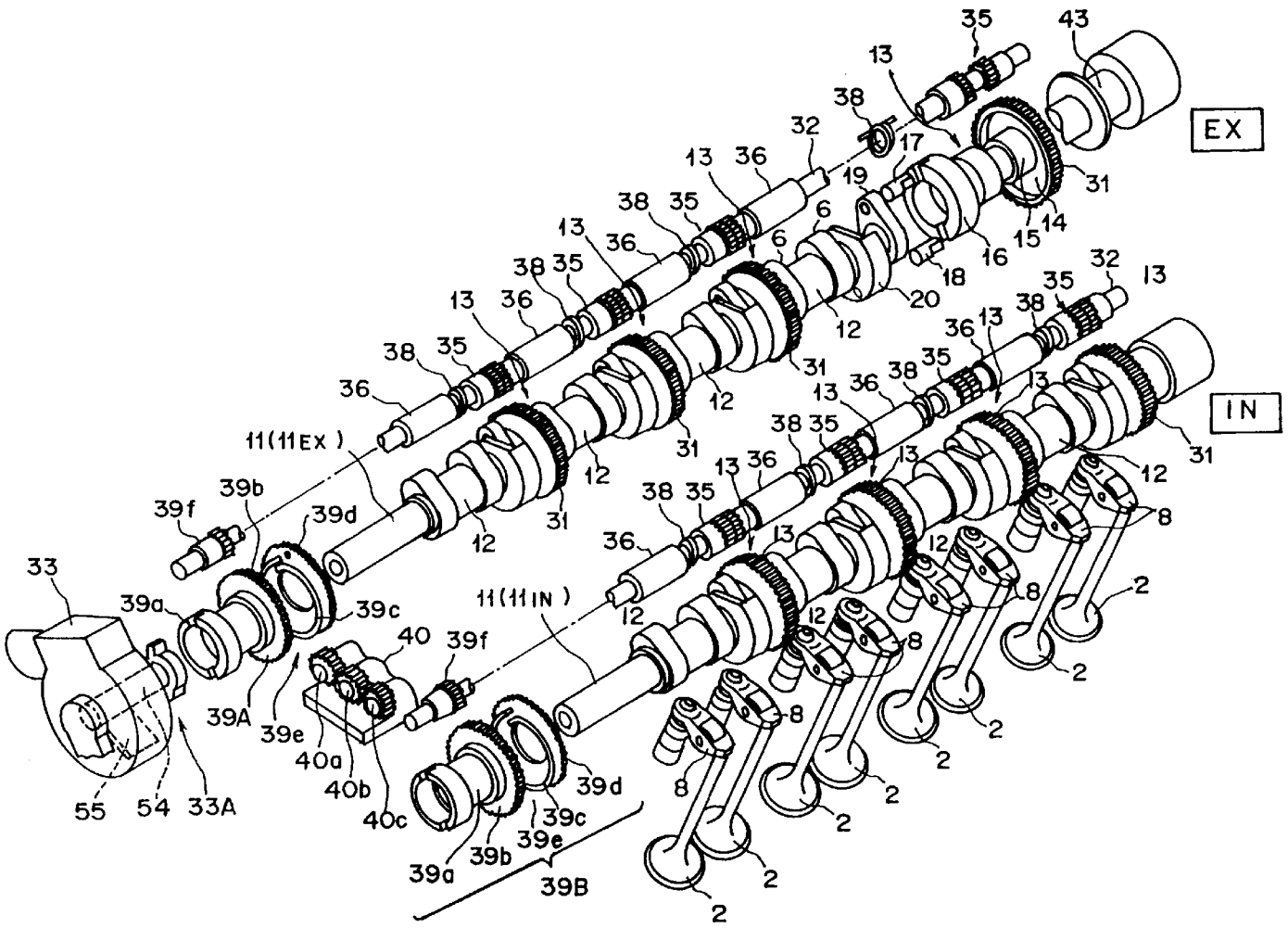
FIG. 9 is an exploded perspective view of the variable valve means in accordance with the first embodiment of the present invention.

When the variable valve mechanism is applied to a four-cylinder engine, the cam lobe 12 and nonuniform coupling 13 are provided for each cylinder. Here, each cylinder comprises a variable valve mechanism for driving an intake valve and a variable valve mechanism for driving an exhaust valve. Namely, as shown in FIG. 9, an in-take-valve camshaft $\mathbf{11}_{IN}$ and an exhaust-valve camshaft $^{11}{}_{EX}$ are provided, and each of them comprises the cam lobe 12 and nonuniform coupling 13 for each cylinder.

Also, the eccentric position adjusting mechanism 30 comprises an eccentric control gear 31 on the control disc 14 side attached to the intake-valve camshaft $\mathbf{11}_{IN}$ for each cylinder; an eccentric control gear 31 on the control disc 14 side attached to the exhaust-valve camshaft $\mathbf{11}_{EX}$ for each cylinder; an intake-valve-side control shaft 32 adjacent to the intake-valve camshaft $\mathbf{11}_{IN}$; an exhaust-valve-side control shaft 32 adjacent to the exhaust-valve camshaft $\mathbf{11}_{EX}$; and a control gear 35, journal 36, and spring 38 attached to each control shaft 32 for each cylinder so as to mesh with each eccentricity control gear 31.

On the other hand, only one actuator 33 is disposed at a non-depicted cylinder-head-side portion at an end part opposite to a sprocket (end member) 43. Here, the actuator 33 is attached to an axial end portion of the exhaust-valve camshaft $\mathbf{11}_{EX}$.

The actuator 33 is connected to an exhaust-valve-side drive gear mechanism 39A via a joint 33A. The driving force of the actuator 33 is transmitted from the exhaust-valve-side drive gear mechanism 39A to the exhaust-valve-side control shaft 32, whereby each eccentricity control gear 31 of the exhaust-valve camshaft $\mathbf{11}_{EX}$ is driven to rotate.

On the other hand, the exhaust-valve-side drive gear mechanism 39A is connected to an intake-valve-side drive gear mechanism 39B via an intermediate gear mechanism 40. The driving force of the actuator 33 is transmitted to the exhaust-valve-side control shaft 32 via the exhaust-valve-side drive gear mechanism 39A, intermediate gear mechanism 40, and intake-valve-side drive gear mechanism 39B, whereby each eccentricity control gear 31 of the intake-valve camshaft $\mathbf{11}_{IN}$ is driven to rotate.

Figure 10:
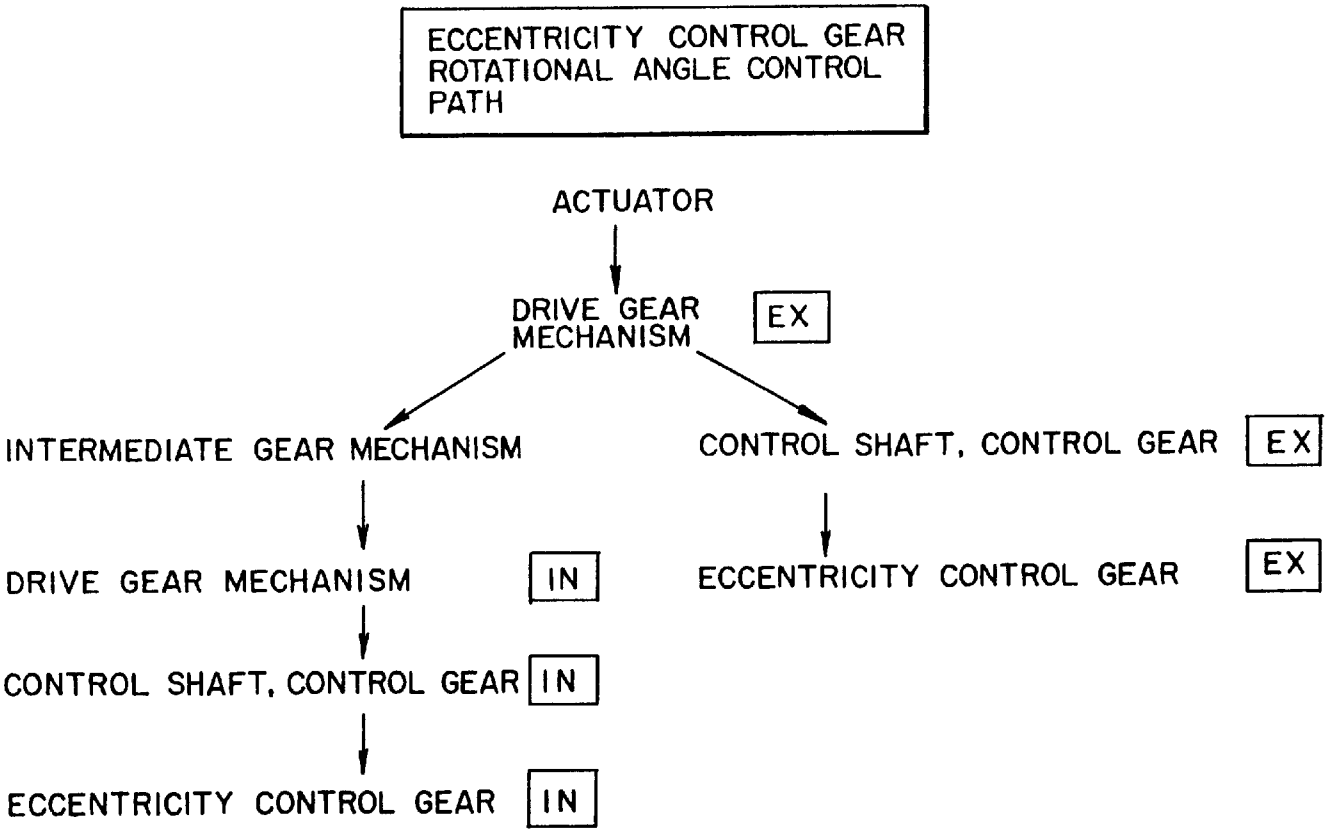
FIG. 10 is a view showing a power-transmitting path for adjusting an eccentric position of the variable valve mechanism in accordance with the first embodiment of the present invention.

Accordingly, as shown in FIG. 10, on the exhaust-valve side (see EX in the drawing), the driving force of the actuator 33 is transmitted to each eccentricity control gear 31 via the drive gear mechanism 39A, exhaust-valve-side control shaft 32, and each control gear 35; whereas, on the intake valve side (see IN in the drawing), the driving force of the actuator 33 is transmitted to each eccentricity control gear 31 via the drive gear mechanism 39A, intermediate gear mechanism 40, drive gear mechanism 39B, intake-valve-side control shaft 32, and each control gear 35.

Here, as shown in FIG. 9, each of the drive gear mechanisms 39A and 39B is constituted by a scissors gear 39*e* which is composed of two gears comprising a fixed gear 39*b*, secured to an axis 39*a*, and a movable gear 39*d* disposed with a spring 39*c* inserted between these gears; and a gear 39*f* secured to an end portion of the control shaft 32. In the scissors gear 39*e*, the movable gear 39*d* is in mesh with the gear 39*f* together with the fixed gear 39*b* while being biased by the spring 39*c* toward the rotating direction, whereby no rattle occurs between the drive gear mechanisms 39A and 39B.

The intermediate mechanism 40 comprises three gears 40*a*, 40*b*, and 40*c* which are in mesh with each other, and transmits the rotation of the axis 39*a* of the exhaust-valve-side drive gear mechanism 39A to the axis 39*a* of the intake-valve-side drive gear mechanism 39B in the same direction and at the same speed.

Further, the scissors gear 39*e* (i.e., gear 39*b*, 39*d*) of each drive gear mechanism 39A, 39B is set to have the same number of teeth as those of each eccentricity control gear 31, while the gear 39*f* of each drive gear mechanism 39A, 39B is set to have the same number of teeth as those of each control gear 35, such that the actuator axis and the eccentricity control gear 31 have the same rotational angle.

Figure 11:
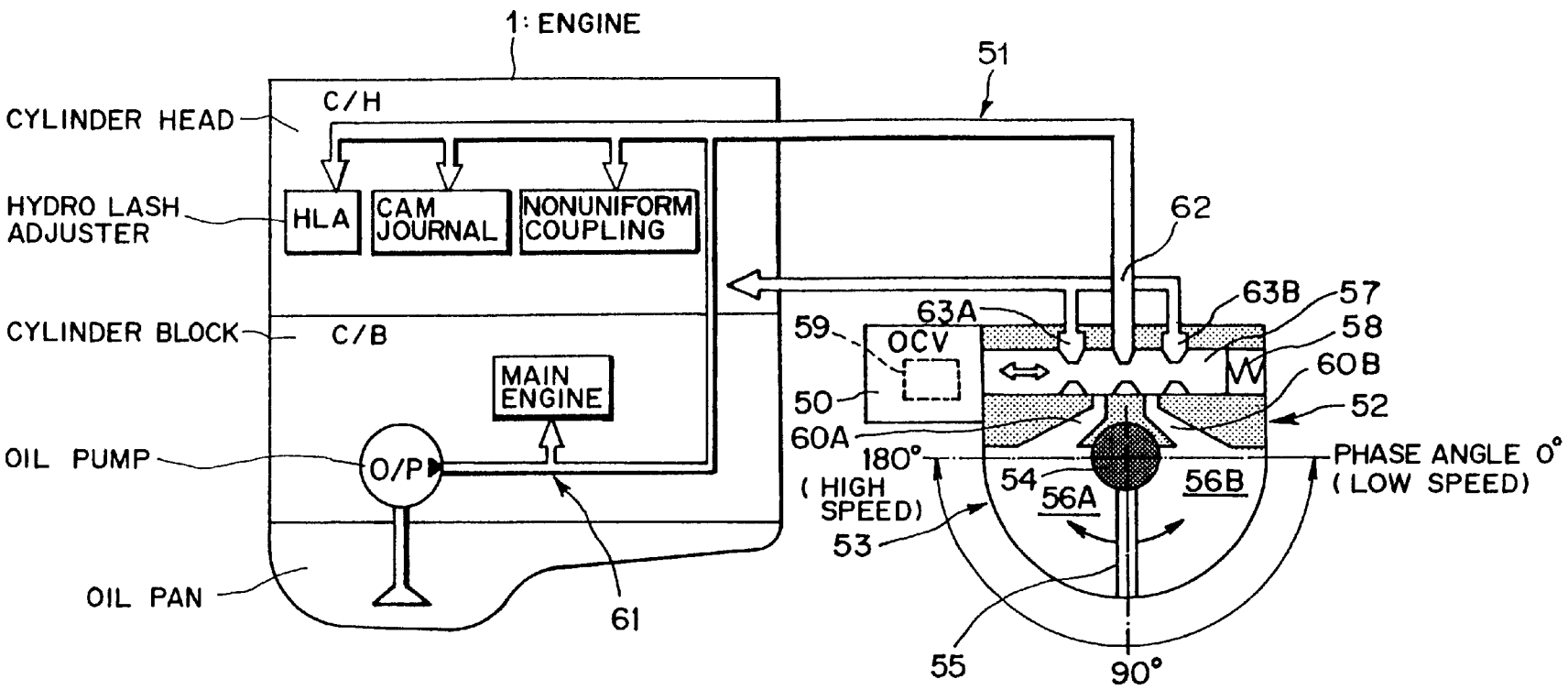
FIG. 11 is a view showing an actuator of an eccentric position adjusting mechanism in the variable valve mechanism in accordance with the first embodiment of the present invention.

Here, the actuator 33 will be explained. For example, as shown in FIG. 11, the actuator 33 comprises hydraulic-pressure supply means 51 including an oil control valve 50, and an actuator main body 52.

The actuator main body 52, which is a so-called hydraulic actuator, rotates a vane 55 around its axis in a reciprocating fashion by means of hydraulic pressure. Namely, as shown in FIG. 11, the actuator main body 52 comprises a housing 53, a shaft section (control shaft) 54 linked to the axis 39*a* of the exhaust-valve-side drive gear mechanism 39A via a joint mechanism (Oldham's joint), the vane 55 radially extending from the axis of the shaft section 54, and a first oil chamber 56A and a second oil chamber 56B which are partitioned by the vane 55.

Accommodated in the upper portion within the housing 53 is a spool valve 57 for the oil control valve 50. The spool valve 57 is biased by a compressed spring 58. When receiving an electromagnetic force from a coil section 59 of the oil control valve 50, the spool valve 57 is adjusted to a desired position against the bias force of the spring 58.

The spool valve 57 is disposed between oil paths 60A and 60B respectively communicating with the first oil chamber 56A and second oil chamber 56B, a hydraulic oil inlet (oil inlet) 62 from an engine oil supply system 61, and drains 63A and 63B for discharging the hydraulic into the cylinder head 1.

When the spool valve 57 is at a neutral position as shown in FIG. 11, the oil paths 60A and 60B are closed, so that the hydraulic pressures in both oil chambers 56A and 56B are neither supplied nor discharged, whereby the vane 55 attains a stationary state.

When the spool valve 57 moves leftward in FIG. 11 from this neutral position, the oil path 60A leading to the first oil chamber 56A and the oil inlet 62 communicate with each other, while the oil path 60B leading to the second oil chamber 56B and the drain 63B communicate with each other, whereby the hydraulic oil is supplied into the first oil chamber 56A, and the hydraulic oil within the second oil chamber 56B is discharged, thus pivoting the vane 55 rightward in FIG. 11.

By contrast, when the spool valve 57 moves rightward in FIG. 11 from the neutral position, the oil path 60A leading to the first oil chamber 56A and the drain 63B communicate with each other, while the oil path 60B leading to the second oil chamber 56B and the oil inlet 62 communicate with each other, the hydraulic oil within the first oil chamber 56A is discharged, and the hydraulic oil is supplied into the second oil chamber 56B, thus pivoting the vane 55 leftward in FIG. 11.

Thus, in response to the position of the spool valve 57, the vane 55 can be pivoted leftward or rightward and fixed. The position of the spool valve 57 can be adjusted by regulating the electromagnetic force of the coil section 59, i.e., by regulating electric power supplied to the coil section 59.

Here, a position sensor for detecting the position (rotational phase) of the vane 55 is provided. As shown in FIG. 2, as the ECU 34 performs feedback control according to the position of the vane 55 received from the position sensor, the electric power supplied to the coil section 59 is regulated so that the vane 55 is adjusted to a predetermined position.

The rotational phase angle of the control disc 14, i.e., the rotation center (second rotation center axis line) $O_2$ of the engagement disc 16 is determined in response to the rotational phase angle of the vane 55. Here, it is set such that the engagement disc 16 attains a low-speed eccentric state when the vane 55 is at the position most rotated to the right (indicated as phase angle 0° in the drawing), and a high-speed eccentric state when the vane 55 is at the position most rotated to the left (indicated as phase angle 180° in the drawing).

Namely, when the vane 55 attains the low-speed eccentric position (vane phase angle of 0° ), the rotation center (second rotation center axis line) $O_2$ of the engagement disc 16 is located below the rotation center (first rotation center axis line) $O_1$ of the camshaft 11 (in the rotational phase direction yielding the valve lift top) as shown in FIGS. 8(*b*1) to 8(*b*5), thus attaining the low-speed eccentric state.

On the other hand, when the vane 55 attains the high-speed eccentric position (vane phase angle of 180° ), the rotation center (second rotation center axis line) $O_2$ of the engagement disc 16 is located above the rotation center (first rotation center axis line) $O_1$ of the camshaft 11 (opposite to the rotational phase direction yielding the valve lift top) as shown in FIGS. 8(*a*1) to 8(*a*5), thus attaining the high-speed eccentric state.

The phase of the vane 55 is adjusted within the range from the low-speed eccentric position (vane phase angle of 0°) to the high-speed eccentric position (vane phase angle of 180°) in response to the engine rotational speed and the like.

The sectional view of the housing 53 shown in FIG. 11 represents a state observed from the same direction as FIGS. 7 and 8 with respect to the camshaft 11. As the vane 55 is pivoted clockwise in FIG. 11, the engagement disc 16 also pivots clockwise in FIGS. 7 and 8. Namely, when the vane 55 is pivoted clockwise from the low-speed side to the high-speed side (i.e., in the direction in which the vane phase angle increases), the engagement disc 16 also pivots clockwise from the low-speed side to the high-speed side. This pivoting direction (clockwise direction) coincides with the rotating direction of the camshaft 11, thus allowing the engagement disc 16 to pivot from the low-speed side to the high-speed side with less load.

Figure 1B:
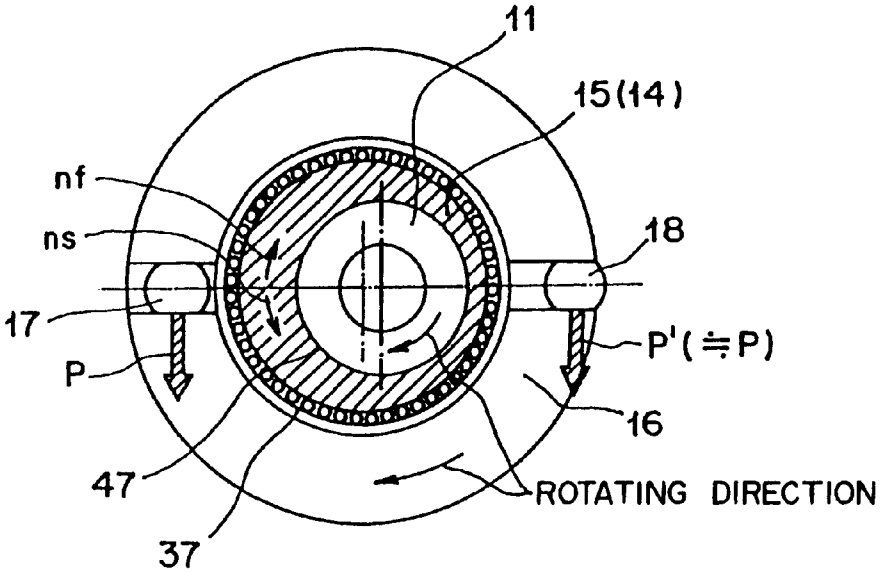
FIGS. 1(A) and 1(B) are schematic sectional views for explaining operation settings for main parts of nonuniform couplings in a variable valve mechanism in accordance with a first embodiment of the present invention, respectively showing the one installed on the intake valve side and the one installed on the exhaust valve side.
Figure 1A:
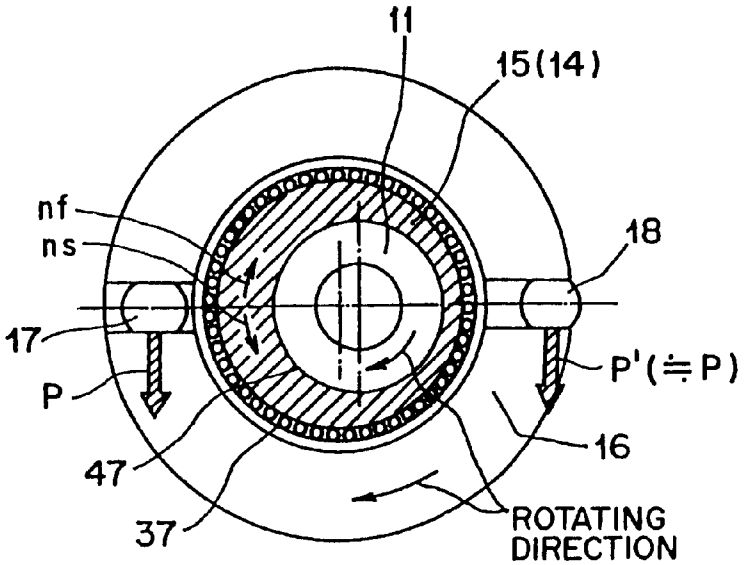

Namely, as shown in FIGS. 1(A) and 1(B), the inner periphery of the eccentric section 15 slides against the outer periphery of the camshaft 11 via an oil film of a sliding bearing 47, whereas the outer periphery thereof slides against the inner periphery of the engagement disc 16 via a bearing 37. The eccentric section 15 is driven by the actuator 33 to rotate for phase adjustment, while it is assumed to be in a fixed state with respect to the engine rotation since it does not pivot relative thereto. Since the camshaft 11 and the engagement disc 16 pivot together with the engine rotation, the eccentric section 15 receives friction torque (dragging torque), in its rotating direction, from the camshaft 11 and engagement disc 16 at its sliding surfaces in the inner and outer peripheries.

Consequently, when the eccentric section 15 is driven to rotate, it is influenced by this friction torque. Thus, when the eccentric section 15 is driven to rotate in the direction along the friction torque, the eccentric section 15 can be rotated by a relatively small driving force as being backed up by the friction torque. Also, when the driving force applied to the eccentric section 15 is constant, the eccentric section 15 can be rapidly driven to rotate.

On the other hand, when the eccentric section 15 is driven to rotate opposite to the friction torque, the latter becomes resistance thereto, whereby a relatively large driving force is required for driving the eccentric section 15 to rotate. Also, when the driving force applied to the eccentric section 15 is constant, it takes time for the eccentric section 15 to be driven to rotate.

In this variable valve mechanism, either on the intake valve side [see FIG. 1(A)] or on the exhaust valve side [see FIG. 1(B)], it is set such that, when the eccentric section 15 is pivoted from the low-speed side (referred to as first position) to the high-speed side (referred to as second position), the eccentric section 15 is driven to rotate in the direction along the friction torque as indicated by arrow nf, whereby the friction torque is utilized to rapidly pivot the eccentric section 15 from the low-speed side to the high-speed side. Of course, when the eccentric section 15 is pivoted from the high-speed side to the low-speed side, the eccentric section 15 is driven to rotate opposite to the friction torque as indicated by arrow ns, whereby the friction torque becomes resistance, thus necessitating longer time for the eccentric section 15 to pivot from the high-speed side to the low-speed side, by contrast.

Here, the friction torque occurring in the sliding surfaces at the inner and outer peripheries of the eccentric section 15 will be explained.

Since this friction torque is generated when a vertical drag is applied to such a sliding surface, which vertical drag applies to the sliding surface will be explained.

First, forces applied to the camshaft 11 and cam lobe 12 and forces applied to the engagement disc 16 through the camshaft 11 and cam lobe 12 will be explained.

Applied to the camshaft 11 is a turning force (i.e., cam driving torque) in response to the rotation of the crankshaft of the engine.

In terms of forces applied to the cam lobe 12, on the other hand, as the valve 2 is lifted (opened), via the cam 6, the cam lobe 12 receives a spring reaction force from the valve spring 3 and an inertia force due to reciprocation of the valve or the like. Consequently, as shown in FIG. 12, the cam rotation driving torque with respect to the valve lift amount VL of the engine attains a characteristic such as that of curve $T_L$ in the low-speed region since it mainly acts against the valve spring force, and a characteristic such as that of curve $T_H$ in the high-speed region since it mainly acts against the inertia load of the valve.

Figure 12:
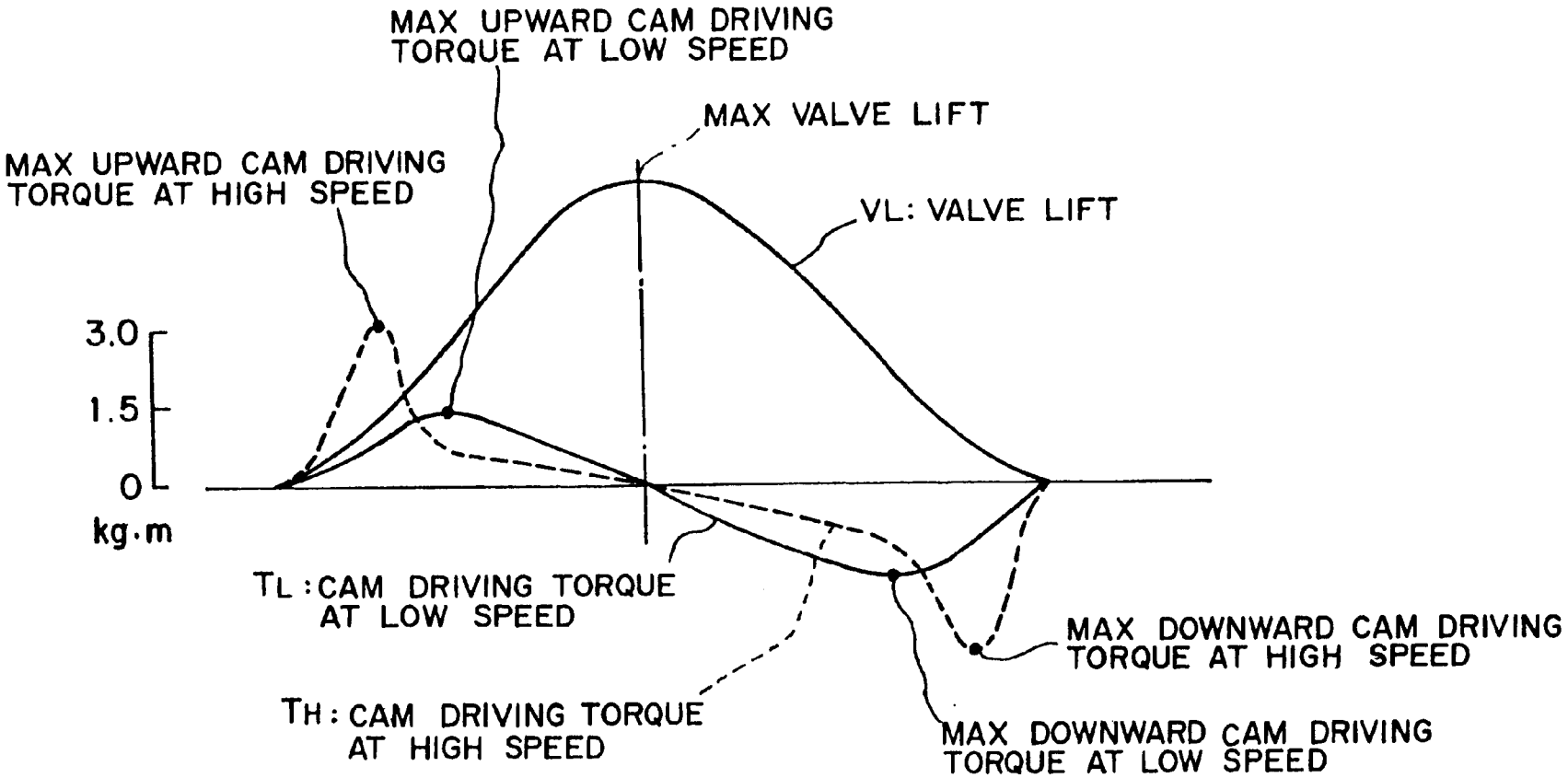
FIG. 12 is a view for explaining a nonuniform speed mechanism in the variable valve mechanism in the first embodiment of the present invention, showing examples of changes in valve lift amount, valve moving speed, and valve moving acceleration in the engine.

As shown in FIG. 12, at the maximum point of valve lift, the direction of the torque acting on the cam is reversed, whereby the cam driving torque changes from positive to negative or vice versa at the maximum point of valve lift.

Forces applied to the engagement disc 16 are a cam driving force $T_1$ as a turning force of the camshaft 11 from the camshaft-side slider 17, a reaction force $F_1$ from the cam-lobe-side slider 18 against the cam driving force $T_1$, whereby a resultant force FF of the cam driving force $T_1$, and reaction force $F_1$ is applied to the engagement disc 16.

Figure 13:
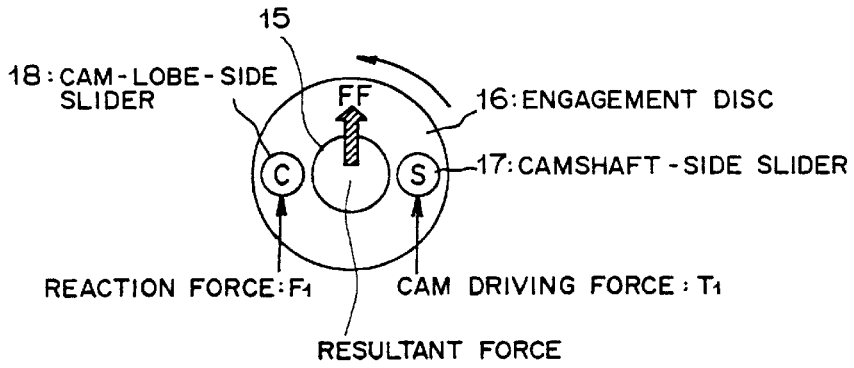
FIG. 13 is a view for explaining a setting for the nonuniform speed mechanism of the variable valve mechanism in the first embodiment of the present invention, illustrating a force applied to the intermediate rotating member (engagement disc)

Here, assuming that the engagement disc 16 rotates counterclockwise, when the valve moves in its opening direction, as shown in FIG. 13, the cam driving force $T_1$ and the reaction force $F_1$ act in rotational directions opposite to each other, whereby the resultant force FF of the cam driving force $T_1$ and reaction force $F_1$ acts in the direction perpendicular to the line connecting the center of the camshaft-side slider 17 and the center of the cam-lobe-side slider 18 and in the reverse rotating direction for the cam-lobe-side slider 18.

In the case where the valve moves in its closing direction, the resultant force FF acts in the direction perpendicular to the line connecting the center of the camshaft-side slider 17 and the center of the cam-lobe-side slider 18 but, opposite to that in FIG. 13, in the rotational direction for the cam-lobe-side slider 18. Also, the direction of such resultant force FF is reversed upon the maximum valve lifting.

The force supporting the engagement disc 16 becomes a force against the resultant force FF, whereas the resultant force FF is generated by the cam driving torque. Accordingly, the cam driving torque acts in the reverse rotating direction for the cam-lobe-side slider 18 when the valve is operated to open, i.e., when the valve lift is rising, whereas it acts in the rotating direction for the cam-lobe-side slider 18 when the valve is operated to close.

Figure 14:
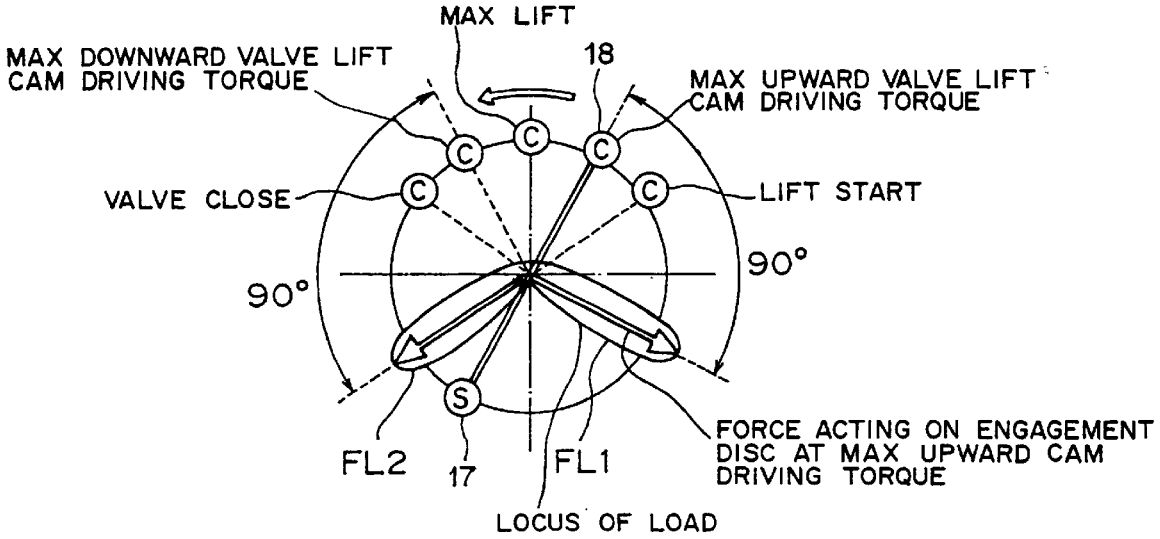
FIG. 14 is a view for explaining a setting for the nonuniform speed mechanism of the variable valve mechanism in the first embodiment of the present invention, illustrating vectors of the force applied to the intermediate rotating member (engagement disc) in response to the phase of a cam.

Therefore, the vector of resultant force FF applied to the engagement disc 16 is represented in response to the phase of the cam 6 as shown in FIG. 14. In this drawing, the position of the cam-lobe-side slider 18 is indicated by C, whereas the camshaft-side slider 17 is indicated by S, and the engagement disc 16 is assumed to rotate counterclockwise.

Also, in FIG. 14, the upward direction of the ordinate indicates the position of the cam-lobe-side slider 18 with respect to the rotation center (first rotation center axis line) $O_1$ at the maximum valve lift, the right side (clockwise direction) from the upward direction in the ordinate indicates the position of the cam-lobe-side slider 18 before the maximum valve lift, whereas the left side (counterclockwise direction) from the upward direction in the ordinate indicates the position of the cam-lobe-side slider 18 after the maximum valve lift.

In FIG. 14, FL1 indicates the magnitude and direction of the resultant force FF applied to the engagement disc 16 when the valve is operated to open, whereas FL2 indicates the magnitude and direction of the resultant force FF applied to the engagement disc 16 when the valve is operated to close.

As indicated by FL1 shown in FIG. 14, when the valve is operated to open, the cam driving force $T_1$ is maximized when the upward cam driving torque reaches the maximum point after the valve is started to open, whereby the resultant force FF applied to the engagement disc 16 is also maximized. The resultant force FF at this time is orthogonal to the line connecting the camshaft-side slider 17 and cam-lobe-side slider 18, and acts in the reverse rotating direction for the cam-lobe-side slider 18. Namely, it shifts ahead of the phase of the camshaft-side slider 17 in the rotating direction by 90°, while shifting behind the phase of the cam-lobe-side slider 18 in the rotating direction by 90°.

On the other hand, as represented by FL2 in FIG. 14, when the valve is operated to close, the cam driving force $T_1$ is maximized at the maximum point of downward cam driving torque before the valve begins to close, whereby the resultant force FF applied to the engagement disc 16 is also maximized. The resultant force FF at this time is orthogonal to the line connecting the camshaft-side slider 17 and cam-lobe-side slider 18 and aligns with the rotating direction for the cam-lobe-side slider 18. Namely, it shifts behind the phase of the camshaft-side slider 17 by 90° in the rotating direction, while shifting ahead of the phase of the cam-lobe-side slider 18 by 90° in the rotating direction. Thus, the two maximum loads applied to the engagement disc 16 are directed like letter V which is oriented opposite to the direction of the cam-lobe-side slider 18 at the maximum valve lift.

In the variable valve mechanism, the valve lift period is adjusted in response to the engine rotational speed and the like, so as to become shorter and longer respectively when the speed is lower and higher. Accordingly, assuming that the resultant force FF applied to the engagement disc 16 is represented by the characteristic view (vector chart) shown in FIG. 14, it can be illustrated as shown in FIGS. 15(A) and 15(B) for respective engine rotational speed regions.

Figure 15A:
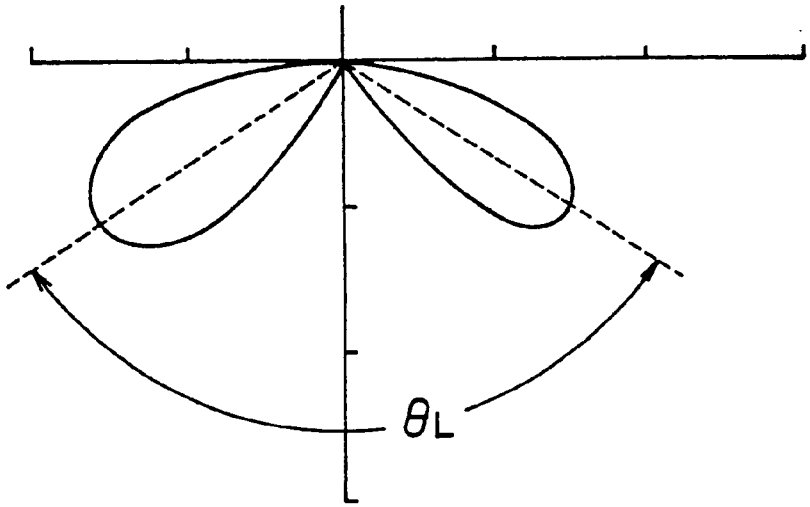
FIGS. 15(A) and 15(B) are views for explaining settings of the nonuniform speed mechanism in the variable valve mechanism in the first embodiment of the present invention, respectively illustrating vectors of forces applied to the intermediate rotating member (engagement disc) in response to the phase of cam in a low speed region and a high speed region.
Figure 15B:
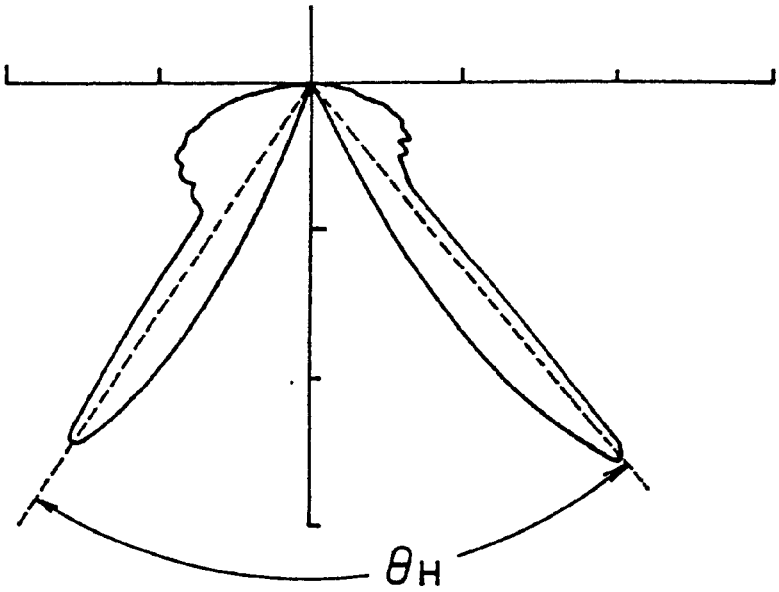

Here, FIGS. 15(A) and 15(B) respectively show the cases of low-speed and high-speed engine rotations.

As shown in FIG. 15(A), at the low-speed engine rotation, the valve lift period is adjusted to become short, while the cam driving torque TL is mainly constituted by the valve spring force, whereby both upward cam driving torque maximum point and downward cam driving torque maximum point approach the maximum valve lift point. Accordingly, in response thereto, the maximum load direction of the resultant force FL1 at the time when the valve is operated to open approaches the rightward direction in abscissa (direction shifted clockwise by 90° from the phase angle of the cam-lobe-side slider 18 at the maximum valve lift); whereas, in response thereto, the maximum load direction of the resultant force FL2 at the time when the valve is operated to close approaches the leftward direction in abscissa (direction shifted counterclockwise by 90° from the phase angle of the cam-lobe-side slider 18 at the maximum valve lift).

Consequently, while the two maximum loads applied to the engagement disc 16 are also directed like letter V oriented opposite to the direction of the cam-lobe-side slider 18 at the maximum valve lift, the angle $\theta_L$ formed between the directions of two maximum loads increases as the valve lift period (valve opening period) is shortened and as the engine speed is lowered.

On the other hand, as shown in FIG. 15(B), at the high-speed engine rotation, the valve lift period is adjusted to become longer, and the cam driving torque $T_H$ is mainly constituted by the inertia force of the valve, whereby both upward cam driving torque maximum point and downward cam driving torque maximum point move away from the maximum valve lift point. Accordingly, in response thereto, the maximum load direction of the resultant force FL1 at the time when the valve is operated to open moves away from the rightward direction in abscissa (direction shifted clockwise by 90° from the phase angle of the cam-lobe-side slider 18 at the maximum valve lift); whereas, in response thereto, the maximum load direction of the resultant force FL2 at the time when the valve is operated to close moves away from the leftward direction in abscissa (direction shifted counterclockwise by 90° from the phase angle of the cam-lobe-side slider 18 at the maximum valve lift).

Consequently, while the engagement ads applied to the engagement disc 16 are also directed like letter V oriented opposite to the direction of the cam-lobe-side slider 18 at the maximum valve lift, the angle formed between the directions of two maximum loads decreases as the valve lift period (valve opening period) is elongated and as the engine speed is enhanced.

Figure 16:
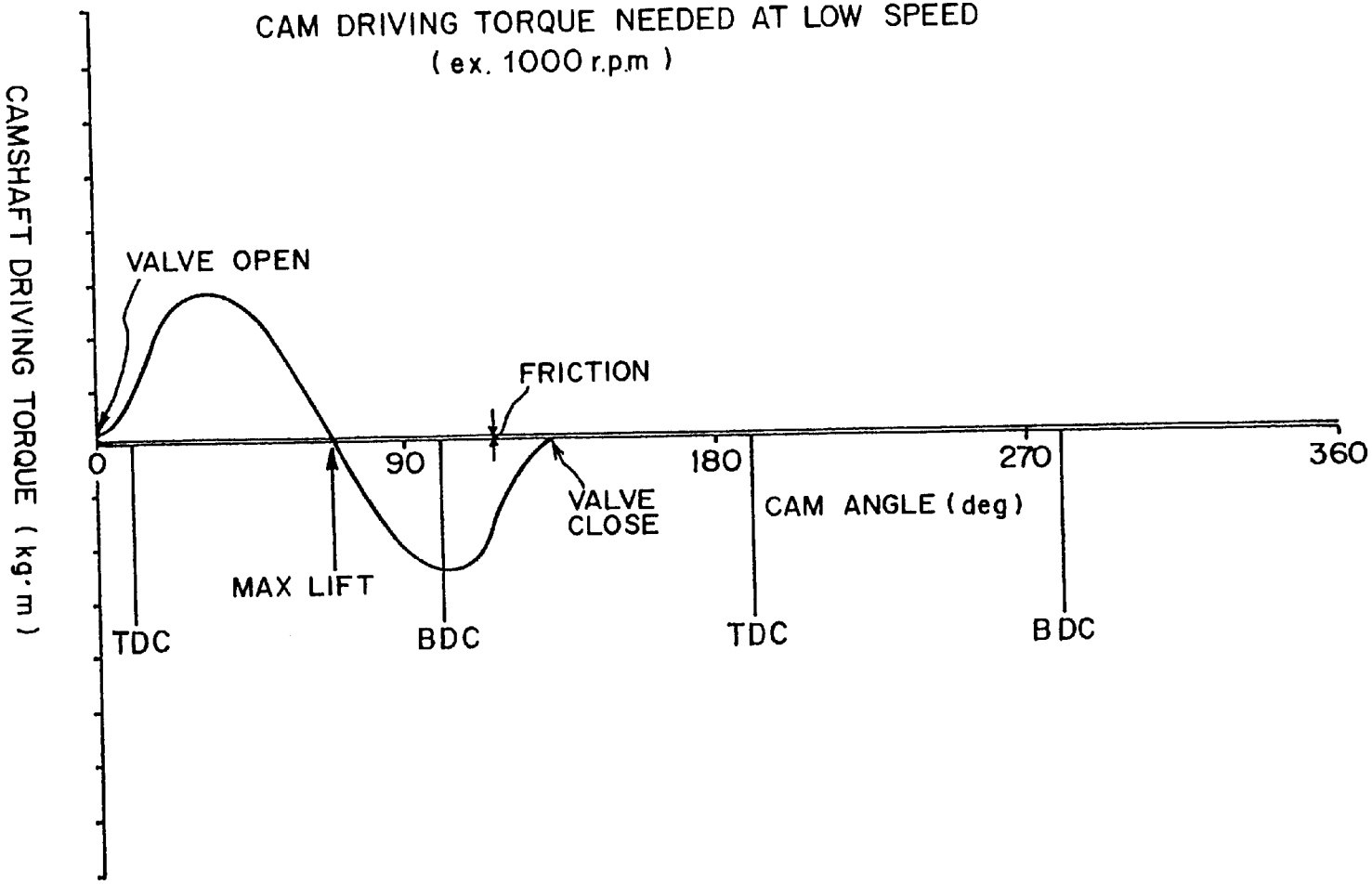
FIG. 16 is a view for explaining a setting of the nonuniform speed mechanism in the variable valve mechanism in the first embodiment of the present invention, showing the torque required for driving the cam in relation to camshaft angle in the case where the engine is in its low speed region.
Figure 17:
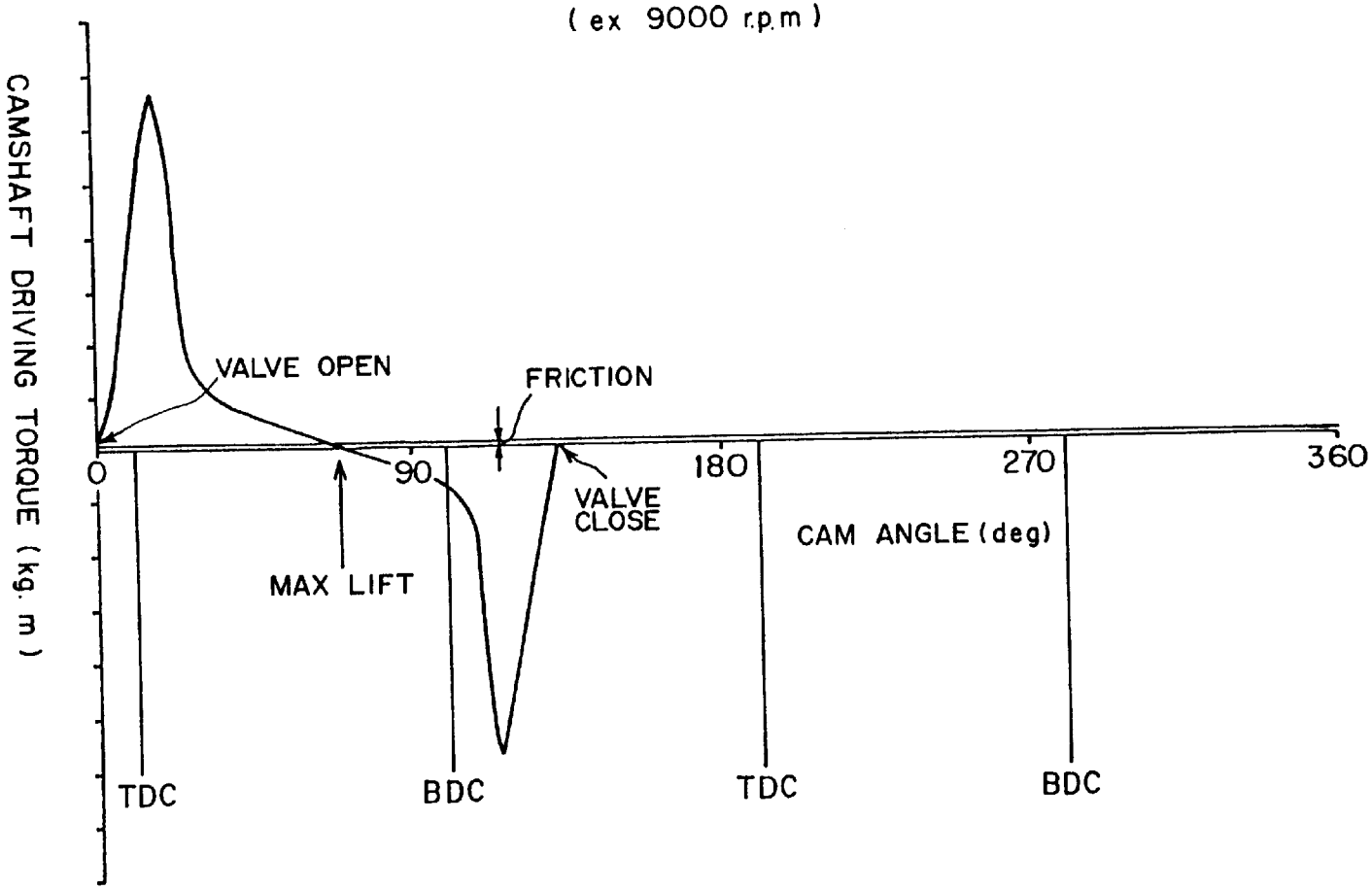
FIG. 17 is a view for explaining a setting of the nonuniform speed mechanism in the variable valve mechanism in the first embodiment of the present invention, showing the torque required for driving the cam in relation to camshaft angle in the case where the engine is in its high speed region.

FIGS. 16 and 17 show cam driving torque required for driving a cam, i.e., cam driving torque to be applied to the engagement disc 16 via the camshaft 11, relative to the rotational angle of the camshaft. FIGS. 16 and 17 respectively show the cases where the engine rotates at low and high speeds. From these charts, it can be seen that, as the engine speed increases, the torque required for driving the cam increases, and the maximum torque point moves farther away from the maximum lift.

Thus, in terms of the force applied to the engagement disc 16, it can be seen that the direction of the force has a constant characteristic as shown in FIGS. 14, 15(A), and 15(B), and as shown in FIGS. 16 and 17 that the higher is the engine speed, the larger becomes the applied force.

Since such a force applied to the camshaft 11 and engagement disc 16 acts as a vertical drag in the sliding surfaces at the inner and outer peripheries of the eccentric section 15, the friction torque corresponding to this vertical drag is applied to such sliding surfaces.

Figure 5:
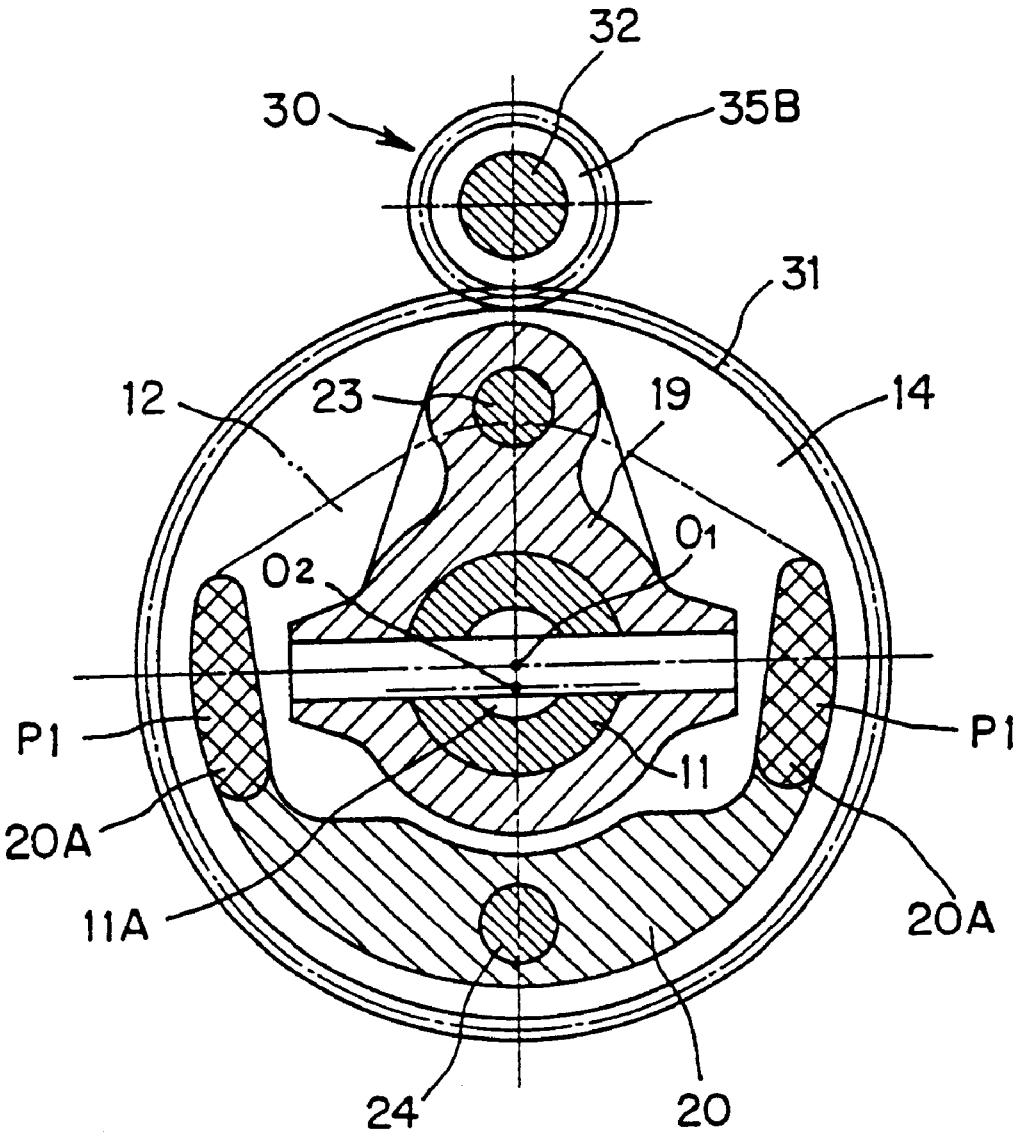
FIG. 5 is a sectional view, taken along line B—B in FIG. 3, showing the nonuniform coupling in the variable valve mechanism in accordance with the first embodiment of the present invention.

In this mechanism, as shown in FIG. 3, one side face 16C of the engagement disc (internal rotating member) 16 opposes the arm section (attachment section) 20 of the cam lobe 12. In particular, the end face (flange section) 20A of the arm section 20 of the cam lobe 12 abuts to one side face of the engagement disc (internal rotating member) 16. As shown in FIGS. 3 and 5, both end faces 20A of the arm section 20 extends to a part which has a phase difference of about 90° or more with respect to the slider groove (second groove section) 16B formed in the engagement disc 16, and this extended portion is disposed outside the axis center as much as possible. One side face of the engagement disc 16 also abuts to thus extended arm section end face (flange section) 20A, whereby the engagement disc 16 abuts to the cam lobe 12 side, thus preventing the engagement disc 16 from tilting (falling) in the axis-swinging direction.

Further, attached to the rear end of the cam lobe 12 is a waved washer 46, by which the abutting force of the arm section end face 20A to the engagement disc 16 is enhanced, so as to secure a sufficient load for preventing the engagement disc 16 from falling.

Also, as mentioned above, the engagement disc 16 and the cam lobe 12 rotate while generating a minute phase difference in response to their eccentricity, whereby the abutting portions of the engagement disc 16 and arm section end face 20A minutely slide against each other. Since lubricant oil (engine oil) is supplied thereto, these portions can slide smoothly.

Figure 6:
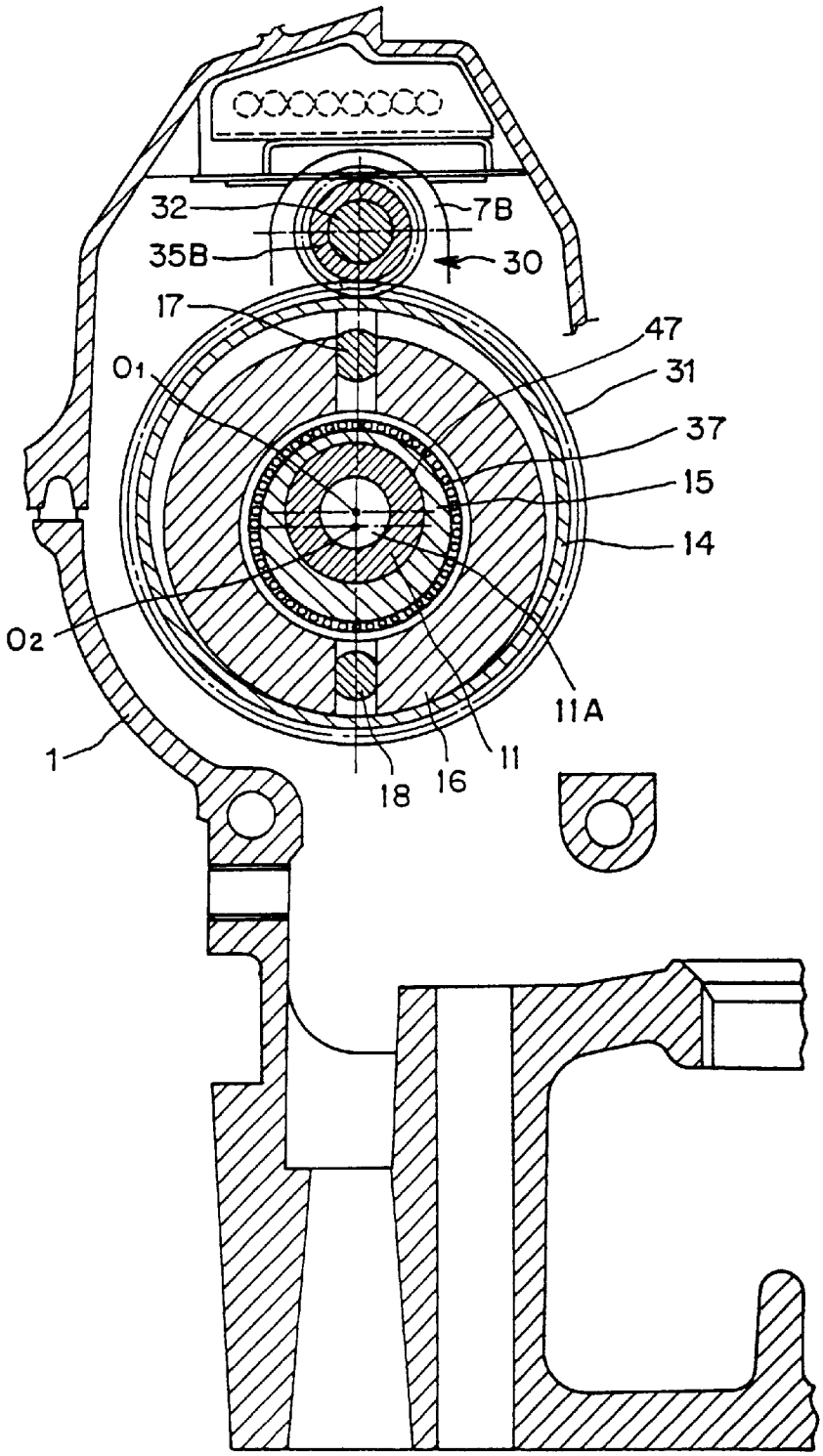
FIG. 6 is a sectional view, taken along line A—A in FIG. 3, showing the nonuniform coupling in the variable valve mechanism in accordance with the first embodiment of the present invention.

Further, in this embodiment, as shown in FIGS. 3 and 6, the above-mentioned bearing 37 is inserted between the sliding parts of the engagement disc 16 and eccentric section 15, i.e., between the outer periphery of the eccentric section 15 and inner periphery of the engagement disc 16. Though a needle bearing which can be inserted more compactly is used here, without being restricted thereto, various kinds of bearings can be employed as the bearing 37.

When such a sliding portion between the engagement disc 16 and eccentric section 15 is formed by "simple sliding bearing", the friction between the engagement disc 16 and eccentric section increases, in particular, due to viscosity of lubricant oil or the like upon starting the engine. As the bearing 37 is installed, the friction between the engagement disc 16 and eccentric section 15 greatly decreases, whereby the transmission of turning force via the engagement disc 16 and the phase adjustment can be performed more smoothly, thus allowing the starting characteristic of the engine to become favorable.

In other words, the load on the starter and actuator upon starting or eccentric position adjustment can be reduced, whereby those having a low capacity and small size can be employed as the starter and actuator.

Though the sliding portion between the eccentric section 15 and camshaft 11 is formed by the sliding bearing (journal bearing) 47, a bearing such as needle bearing may be disposed between the sliding parts between the eccentric section 15 and camshaft 11, such that bearings are installed at both the sliding portion between the engagement disc 16 and eccentric section 15 and the sliding portion between the eccentric section 15 and camshaft 11.

On the other hand, when bearings are installed at both sliding portions, the system may increase its size and may lower its loading characteristic. If it matters, a bearing will be installed at one of the sliding portions. In this case, the bearing is preferably inserted between the engagement disc 16 and eccentric section 15, having a diameter greater than that of the camshaft 11 and eccentric section 15, since a bearing property can be exhibited more effectively.

Numerals 7E, 11A, and 11B in FIG. 3 refer to oil holes for supplying lubricant oil (engine oil) to the respective sliding portions.

Since the variable valve mechanism in accordance with the first embodiment of the present invention is configured as mentioned above; in the internal combustion engine equipped with such a variable valve mechanism, the valve opening characteristic is controlled while the rotational phase of the control disc 14 is adjusted via the eccentric position adjusting mechanism 30.

Namely, in the ECU 34, according to the engine speed information, AFS information, and the like, the rotational phase of the control disc 14 corresponding to the rotational speed and load state of the engine is set, and the control disc 14 is driven via the operation control of the actuator 33 such that the actual rotational phase of the control disc 14 attains thus set state according to the detection signal of the position sensor.

Also, through the operation control of the actuator 33 effected by the ECU 34, the eccentric section 15 is pivoted so as to adjust the phase angle such that, while the rotation center (second rotation center axis line) $O_2$ of the engagement disc 16 is displaced, the phase angle characteristic approaches the curve VL1 in FIG. 8 as the rotational speed and load of the engine increase, for example, thereby elongating the valve opening period, whereas it approaches the curve VL2 in FIG. 8 as the rotational speed and load of the engine decrease, thereby shortening the valve opening period.

Thus, while the rotational phase (position) of the control disc 14 is controlled in response to the engine operation state, the valve can be driven optimally for the engine operation state. In particular, since the valve lift characteristic can be adjusted continuously, the valve can always be driven with a characteristic optimal for the engine operation state.

Also, in the variable valve mechanism, either on the intake valve side [see FIG. 1(A)] or on the exhaust valve side [see FIG. 1(B)], when the eccentric section 15 pivots from the low-speed side to the high-speed side, the eccentric section 15 is driven to rotate in the direction along the friction torque (dragging torque), whereby the eccentric section 15 can be rapidly pivoted from the low-speed side to high speed side of the eccentric section 15 by use of the friction torque.

Accordingly, while the engine speed is increasing (engine is accelerated), or the vehicle speed is increasing (accelerated) in an automobile engine, the response for changing the low-speed side to high-speed side of the valve timing is sped up, whereby the optimal timing corresponding to the rotational speed (corresponding to the vehicle speed) can be rapidly achieved upon acceleration as well, thus contributing to improvement in acceleration performances such as improvement in acceleration feeling. It is also advantageous in that such an excellent acceleration response can be realized by the actuator 33 having a relatively small capacity without increasing the capacity thereof.

Also, in this embodiment, as shown in FIG. 9, while the scissors gear (control gear) 35 is incorporated in the control shaft 32 in view of the space of each cylinder; at the camshaft end portion on the actuator 33 side, in order to prevent backlash from occurring with respect to the intermediate gear mechanism 40, the scissors gear 39*e* is installed in the gears not on the control shaft 32 side but on the camshaft 11 side.

Accordingly, at the camshaft-side end portion, while the scissors gears 39*e*, 39*e* respectively incorporated on the side of the two camshafts 11 for intake (IN) and exhaust (EX) act together, backlash can be effectively prevented in both the control shafts 32, 32 and intermediate gear mechanism 40.

In the following, a second embodiment of the present invention will be explained. This embodiment is set such that, though each constituent of the mechanism is similar to that in the first embodiment, as shown in FIGS. 18(A) and 18(B), contrary to the first embodiment, when the eccentric section 15 is pivoted from the high-speed side (second position) to the low-speed side (first position), the eccentric section 15 is driven to rotate in the direction ns along the friction torque (dragging torque), whereby the eccentric section 15 can rapidly pivot from the high speed side to the low speed side by use of the friction torque.

Of course; when the eccentric section 15 is pivoted from the low-speed side (first position) to the high-speed side (second position), the eccentric section 15 is driven to rotate in the direction nf opposite to the friction torque (dragging torque). Such setting of the pivotal direction of the eccentric section 15 is similarly effected on both the intake valve side [see FIG. 18(A)] and exhaust valve side [see FIG. 18(B)].

Such setting takes account of the characteristic that a vehicle engine is typically equipped with a transmission, whereby, upon acceleration of the vehicle, the engine speed drastically decreases together with up-shifting.

Namely, as can be seen from FIG. 19 which shows the result of investigation concerning a changing characteristic of engine speed when the transmission is successively upshifted from the first speed to second and third speeds, the descending rate of engine speed upon upshifting is three times as much as the ascending rate of the engine speed with no shift change in the case of upshifting from the first to second speed in which their difference is the smallest, and becomes greater upon up-shifting from the second to third speed. Accordingly, it can be seen that the engine speed drastically decreases upon upshifting.

In view of such a characteristic of the transmission, it is desirable that, in order to attain an optimal valve-opening characteristic, the eccentric section 15 be pivoted from the high-speed side to the low-speed side without failing to catch up with the drastic decrease in engine speed caused by upshifting, so that the valve timing is changed from the high-speed side to the low-seed side more rapidly. Therefore, the friction torque is utilized to pivot the eccentric section 15 from the high-speed side to the low-speed side, thus allowing the valve timing to be changed rapidly.

Since the variable valve mechanism in accordance with the second embodiment of the present invention is configured as mentioned above; in the internal combustion engine equipped with such variable valve mechanism, either on the intake valve side or exhaust valve side, as shown in FIGS. 18(A) and 18(B), when the eccentric section 15 is pivoted from the high-speed side to the low-speed side, the eccentric section 15 is driven to rotate in the direction along the friction torque (dragging torque), whereby the eccentric section 15 can be rapidly pivoted from the high-speed side to the low-speed side by use of the friction torque.

Consequently, without failing to catch up with the drastic decrease in engine speed caused by upshifting, the eccentric section 15 can be pivoted from the high-speed side to the low-speed side, whereby the valve timing can be rapidly changed from the high-speed side to the low-speed side. Accordingly, in the automobile engine, when the vehicle speed increases (upon acceleration), the optimal valve timing corresponding to the engine rotational speed can be rapidly attained even upon upshifting, thus contributing to improvement in acceleration performances such as improvement in acceleration feeling. It is also advantageous in that such an excellent acceleration response can be realized by the actuator 33 having a relatively small capacity without increasing the capacity thereof.

In the following, a third embodiment of the present invention will be explained.

Figure 20B:
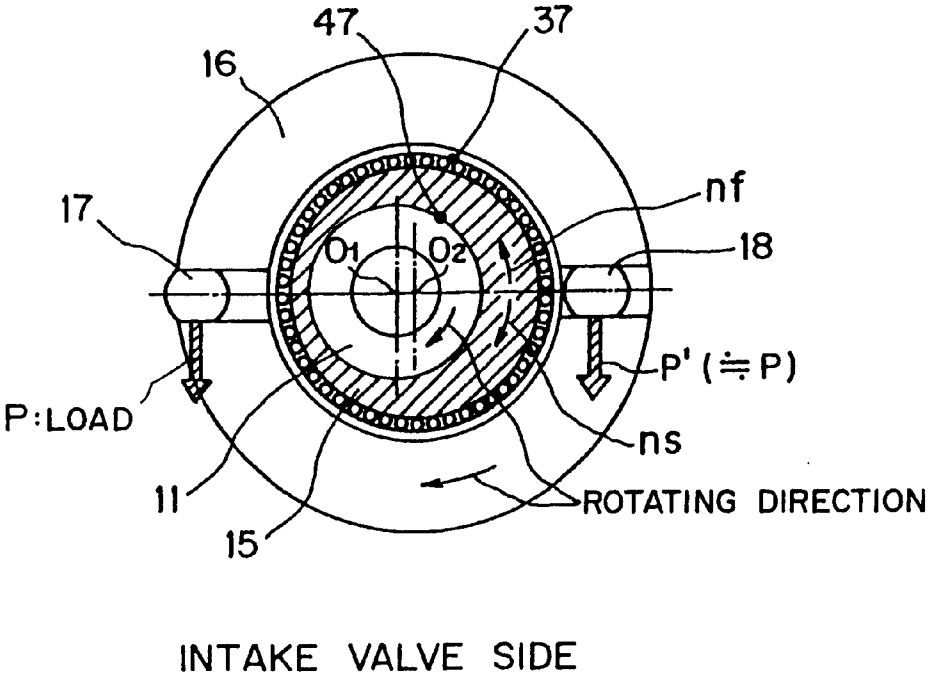
FIGS. 20(A) and 20(B) are schematic sectional views for explaining operation settings of main parts of nonuniform couplings in the variable valve mechanism in accordance with a third embodiment of the present invention, respectively illustrating the one installed on the intake side and the one installed on the exhaust side.
Figure 20A:
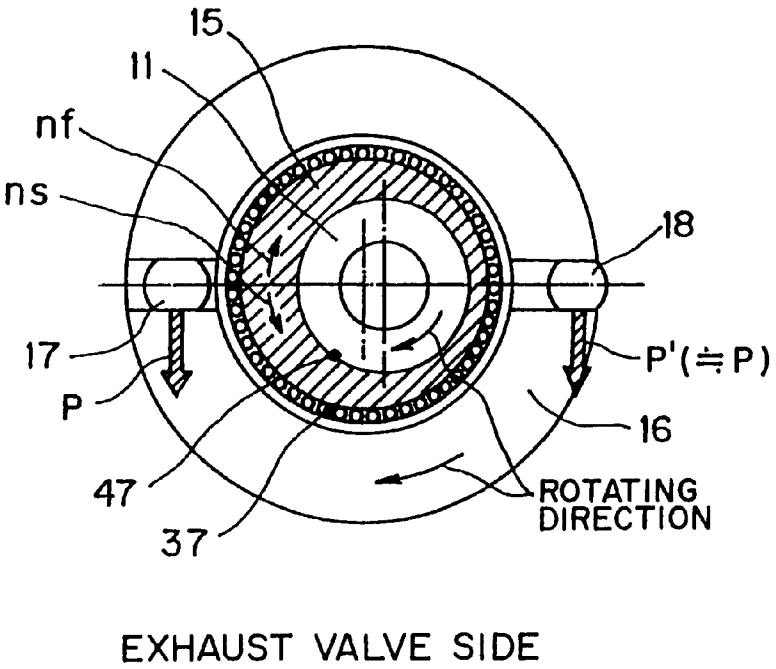

This embodiment is set such that, though each constituent of the mechanism is similar to that in the first embodiment, as shown in FIGS. 20(A) and 20(B), when the eccentric section 15 is pivoted from the low-speed side to the high-speed side, the eccentric section 15 on the exhaust side [see FIG. 20(A)] is driven to rotate in the direction nf along the friction torque (dragging torque), whereas the eccentric section 15 on the intake side [see FIG. 20(B)] is driven to rotate in the direction nf opposite to the friction torque (dragging torque).

Accordingly, when the eccentric section 15 is pivoted from the high-speed side to the low-speed side, by contrast, the eccentric section 15 on the exhaust side is driven to rotate in the direction ns opposite to the friction torque (dragging torque), whereas the eccentric section 15 on the intake side is driven to rotate in the direction ns along the friction torque (dragging torque).

Also, as with the first and second embodiments, the respective eccentric position adjusting mechanisms 30, 30 on the exhaust valve side and intake valve side are driven by the single actuator 33.

Since the variable valve mechanism in accordance with the third embodiment of the present invention is configured as mentioned above; when the eccentric section 15 is pivoted from the low-speed side (first position) to the high-speed side (second position), the eccentric section 15 on the exhaust valve side is driven to rotate in the direction nf along the friction torque (dragging torque), whereby the driving load becomes smaller as being backed up by the friction torque, whereas the eccentric section 15 on the intake valve side is driven to rotate in the direction nf opposite to the friction torque (dragging torque), whereby the driving torque becomes greater as being resisted by the friction torque.

On the other hand, when the eccentric section 15 is pivoted from the high-speed side (second position) to the low-speed side (first position), the eccentric section 15 on the exhaust valve side is driven to rotate in the direction ns opposite to the friction torque (dragging torque), thereby yielding a larger driving load as being resisted by the friction torque, whereas the eccentric section 15 on the intake valve side is driven to rotate in the direction ns along the friction torque (dragging torque), thereby yielding a smaller driving load as being backed up by the friction torque.

Since the eccentric position adjusting mechanism 30 of each variable valve mechanism on the exhaust valve side and intake valve side is driven by the single actuator 33, the latter is simultaneously influenced by the friction torque on the exhaust valve side and the friction torque on the intake valve side.

Accordingly, when the eccentric section 15 is pivoted from the low-speed side to the high-speed side, the resistance (i.e., increase in load) effected by friction torque on the intake valve side is canceled by the backup (i.e., decrease in load) effected by the friction torque on the exhaust valve side, whereby the actuator 33, as a whole (when the exhaust valve side and intake valve side are collectively taken into account), is hardly influenced by such friction torque.

Similarly, when the eccentric section 15 is pivoted from the high-speed side to the low-speed side, the resistance (i.e., increase in load) effected by the friction torque on the exhaust valve side is canceled by the backup (i.e., decrease in load) effected by the friction torque on the intake valve side, whereby the actuator 33, as a whole (when the exhaust valve side and intake valve side are collectively taken into account), is hardly influenced by such friction torque.

Accordingly, changing the valve timing toward the acceleration and deceleration sides of the engine can be effected with substantially the same response without being influenced by the friction torque (dragging torque), whereby this embodiment is advantageous in that the valve timing control can be set easily.

Figure 21B:
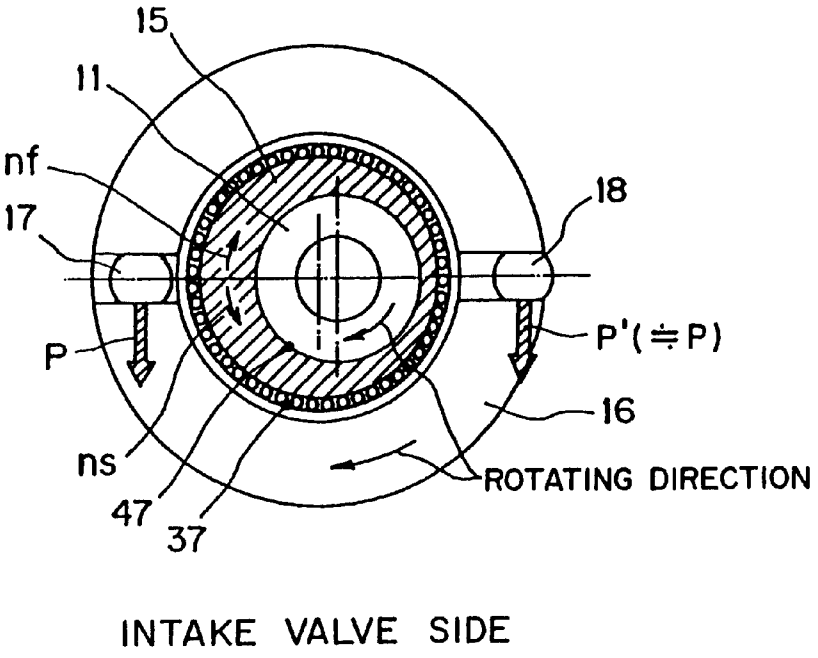
FIGS. 21(A) and 21(B) are schematic sectional views for explaining operation settings of main parts of nonuniform couplings in the variable valve mechanism in accordance with a fourth embodiment of the present invention, respectively illustrating the one installed on the intake side and the one installed on the exhaust side.
Figure 21A:
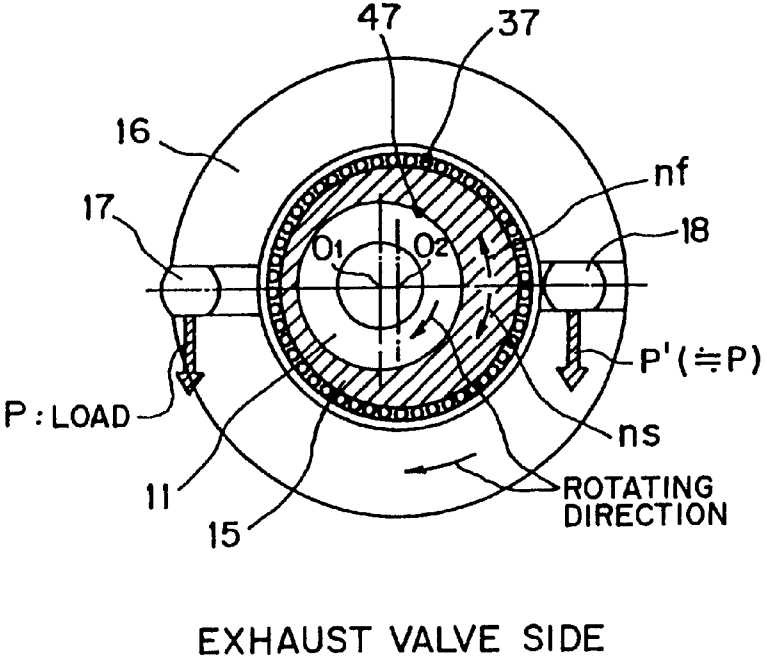

In the following, a fourth embodiment of the present invention will be explained. This embodiment is set such that, though each constituent of the mechanism is similar to that in the first embodiment, as shown in FIGS. 21(A) and 21(B), contrary to the third embodiment, when the eccentric section 15 is pivoted from the low-speed side (first position) to the high-speed side (second position), the eccentric section 15 on the exhaust side [see FIG. 21(A)] is driven to rotate in the direction nf opposite the friction torque (dragging torque), whereas the eccentric section 15 on the intake side [see FIG. 21(B)] is driven to rotate in the direction nf along the friction torque (dragging torque).

Accordingly, by contrast, when the eccentric section is pivoted from the high-speed side (second position) to the low-speed side (first position), the eccentric section 15 on the exhaust valve side is driven to rotate in the direction nf along the friction torque (dragging torque), whereas the eccentric section 15 on the intake valve side is driven to rotate in the direction ns opposite to the friction torque (dragging torque).

Also, as with the first to third embodiments, the respective eccentric position adjusting mechanisms 30, 30 are driven by the single actuator 33.

Since the variable valve mechanism in accordance with the fourth embodiment of the present invention is configured as mentioned above, as with the third embodiment, when the eccentric section 15 is pivoted from the low-speed side to the high-speed side or from the high-speed side to the low-spee dside, the resistance (i.e., increase in load) effected by the friction torque on one of the exhaust valve side and intake valve side is canceled by the backup (i.e., decrease in load) effected by the friction torque on the other side, whereby the actuator 33, as a whole (when the exhaust valve side and intake valve side are collectively taken into account), is hardly influenced by such friction torque.

Accordingly, as with the third embodiment, changing the valve timing toward the acceleration and deceleration sides of the engine can be effected with substantially the same response without being influenced by the friction torque (dragging torque), whereby this embodiment is advantageous in that the valve timing control can be set easily.

Though both exhaust valve side and intake valve side are driven by the single actuator in each embodiment, they may be driven separately as well. Also, the configuration in accordance with each embodiment may be partly applied to one of the exhaust valve side and intake valve side as well.

Without being restricted to the variable valve mechanism of each embodiment, the present invention is also applicable to each variable valve mechanism referred to in the column of Background Art with its corresponding publication number.

Further, though the axis centers of the first pin element and second pin element are shifted by about 180° from each other around the first rotation center axis line $O_1$ so that the axis center of the first pin element, first rotation center axis line $O_1$, and the axis center of the second pin element substantially align with each other in the variable valve mechanism of each embodiment; the relative positional relationship between the axis center of the first pin element, first rotation center axis line $O_1$, and the axis center of the second pin element is not restricted thereto, namely, the axis center of the first pin element, first rotation center axis line $O_1$, and the axis center of the second pin element may be disposed with an angle other than 180° (e.g., either an obtuse or acute angle).

Further, since the nonuniform coupling 13 can be disposed for each cylinder, without being limited by the form and type of the engine, the mechanism of the present invention can be applied to all the types of engines including various type of straight multi-cylinder engines such as four-cylinder engines.

Also, without being restricted to the valve driving form between the valve stem and cam shown in each embodiment, the variable valve mechanism of this invention is also applicable to various kinds of the valve driving forms described as Background Art.

What is claimed is:

1. A variable valve mechanism comprising:

a first rotation axis member driven to rotate around a first rotation axis center in response to a turning force transmitted from a crankshaft of an internal combustion engine;

an axis-supporting member equipped with an axis-supporting section having a second rotation axis center which is different from and in parallel to said first axis center, said axis-supporting member being disposed around an outer periphery of said first rotation axis member so as to be able to rotate or swing relative thereto such that said second rotation axis center can be displaced;

an intermediate rotating member axially supported by said axis-supporting member;

a first connecting member linking said intermediate rotating member to said first rotation axis member so that said intermediate rotating member can rotate together with said first rotation axis member;

a second rotation axis member which rotates around said first rotation axis center and has a cam section;

a second connecting member linking said second rotation axis member to said intermediate rotating member so that said second rotation axis member can rotate together with said intermediate rotating member;

a valve member for setting an intake flow period or exhaust discharge period with respect to a combustion chamber of said internal combustion engine via said cam section in response to a rotational phase of said second rotation axis member; and a control member, driven by an actuator, for displacing said second rotation axis center, which is a rotation center of said axis-supporting section of said axis-supporting member, between first and second positions in response to an operation state of said internal combustion engine;

wherein, when an engine speed of said internal combustion engine increases, said axis-supporting member is displaced from said first position to said second position via said control member, and wherein the direction of displacement from said first position to said second position aligns with a dragging torque occurring between said intermediate rotating member and axis-supporting member or between said axis-supporting member and first rotation axis member.

2. A variable valve mechanism comprising:

a first rotation axis member driven to rotate around a first rotation axis center in response to a turning force transmitted from a crankshaft of an internal combustion engine;

an axis-supporting member equipped with an axis-supporting section having a second rotation axis center which is different from and in parallel to said first axis center, said axis-supporting member being disposed around an outer periphery of said first rotation axis member so as to be able to rotate or swing relative thereto such that said second rotation axis center can be displaced;

an intermediate rotating member axially supported by said axis-supporting member;

a first connecting member linking said intermediate rotating member to said first rotation axis member so that said intermediate rotating member can rotate together with said first rotation axis member;

a second rotation axis member which rotates around said first rotation axis center and has a cam section;

a second connecting member linking said second rotation axis member to said intermediate rotating member so that said second rotation axis member can rotate together with said intermediate rotating member;

a valve member for setting an intake flow period or exhaust discharge period with respect to a combustion chamber of said internal combustion engine via said cam section in response to a rotational phase of said second rotation axis member; and a control member, driven by an actuator, for displacing said second rotation axis center, which is a rotation center of said axis-supporting section of said axis-supporting member, between first and second positions in response to an operation state of said internal combustion engine;

wherein, when an engine speed of said internal combustion engine increases, said axis-supporting member is displaced from said first position to said second position via said control member, and wherein the direction of displacement from said first position to said second position is set opposite to a dragging torque occurring between said intermediate rotating member and axis-supporting member or between said axis-supporting member and first rotation axis member.

3. An internal combustion engine in which variable valve mechanisms are respectively disposed on intake and exhaust sides thereof, each of said variable valve mechanisms comprising:

a first rotation axis member driven to rotate around a first rotation axis center in response to a turning force transmitted from a crankshaft of said internal combustion engine;

an axis-supporting member equipped with an axis-supporting section having a second rotation axis center which is different from and in parallel to said first axis center, said axis-supporting member being disposed around an outer periphery of said first rotation axis member so as to be able to rotate or swing relative thereto such that said second rotation axis center can be displaced;

an intermediate rotating member axially supported by said axis-supporting member;

a first connecting member linking said intermediate rotating member to said first rotation axis member so that said intermediate rotating member can rotate together with said first rotation axis member;

a second rotation axis member which rotates around said first rotation axis center and has a cam section;

a second connecting member linking said second rotation axis member to said intermediate rotating member so that said second rotation axis member can rotate together with said intermediate rotating member;

a valve member for setting an intake flow period or exhaust discharge period with respect to a combustion chamber of said internal combustion engine via said cam section in response to a rotational phase of said second rotation axis member;

a control member for displacing said second rotation axis center, which is a rotation center of said axis-supporting section of said axis-supporting member, between first and second positions in response to an operation state of said internal combustion engine; and an actuator for driving directly or indirectly via a transmission mechanism said axis-supporting member provided for said variable valve mechanism on said intake side or said axis-supporting member provided for said variable valve mechanism on said exhaust side;

wherein, when an engine speed of said internal combustion engine increases, said axis-supporting member on said intake side and said axis-supporting member on said exhaust side are displaced from said first position to said second position via said actuator, and wherein each of the direction of displacement from said first position to said second position of said axis-supporting member on said intake side and the direction of displacement from said first position to said second position of said axis-supporting member on said exhaust side is set to align with or opposite to a dragging torque occurring between said intermediate rotating member and axis-supporting member or between said axis-supporting member and first rotation axis member.

4. An internal combustion engine in which variable valve mechanisms are respectively disposed on intake and exhaust sides thereof, each of said variable valve mechanisms comprising:

a first rotation axis member driven to rotate around a first rotation axis center in response to a turning force transmitted from a crankshaft of said internal combustion engine;

an axis-supporting member equipped with an axis-supporting section having a second rotation axis center which is different from and in parallel to said first axis center, said axis-supporting member being disposed around an outer periphery of said first rotation axis member so as to be able to rotate or swing relative thereto such that said second rotation axis center can be displaced;

an intermediate rotating member axially supported by said axis-supporting member;

a first connecting member linking said intermediate rotating member to said first rotation axis member so that said intermediate rotating member can rotate together with said first rotation axis member;

a second rotation axis member which rotates around said first rotation axis center and has a cam section;

a second connecting member linking said second rotation axis member to said intermediate rotating member so that said second rotation axis member can rotate together with said intermediate rotating member;

a valve member for setting an intake flow period or exhaust discharge period with respect to a combustion chamber of said internal combustion engine via said cam section in response to a rotational phase of said second rotation axis member;

a control member for displacing said second rotation axis center, which is a rotation center of said axis-supporting section of said axis-supporting member, between first and second positions in response to an operation state of said internal combustion engine; and an actuator for driving directly or indirectly via a transmission mechanism said axis-supporting member provided for said variable valve mechanism on said intake side or said axis-supporting member provided for said variable valve mechanism on said exhaust side;

wherein, when an engine speed of said internal combustion engine increases, said axis-supporting member on said intake side and said axis-supporting member on said exhaust side are displaced from said first position to said second position via said actuator, and wherein one of the direction of displacement from said first position to said second position of said axis-supporting member on said intake side and the direction of displacement from said first position to said second position of said axis-supporting member on said exhaust side is set to align with a dragging torque occurring between said intermediate rotating member and axis-supporting member or between said axis-supporting member and first rotation axis member, whereas the other is set opposite to said dragging torque.

5. A variable valve mechanism for driving an engine valve in an engine comprising:

a cam member disposed around an outer periphery of a camshaft, said camshaft rotatable about a first axis of rotation to drive said cam member to open and close the engine valve;

a coupling including a control disc for controlling a time period for which the engine valve remains open, said control disc having an eccentric section which is pivotally supported by the outer periphery of said camshaft and rotatable around a second axis of rotation different from and parallel to the first axis of rotation, said control disc being pivotal between a first position corresponding to a first engine speed and a second position corresponding to second engine speed; and a control member rotating said control disc to displace said control disc from the first position to the second position in response to the engine changing from the first engine speed to the second engine speed, said control member displacing said control disc such that the eccentric section of said control disc rotates in a direction aligned with a direction of dragging torque generated between said control disc and said camshaft so that rotation of said control disc is driven in part by the dragging torque.

6. The variable valve mechanism according to claim 5, wherein the first engine speed is slower than the second engine speed.

7. The variable valve mechanism according to claim 5, wherein the first engine speed is faster than the second engine speed.

8. The variable valve mechanism according to claim 5, wherein said coupling further including an engagement disc disposed around an outer periphery of the eccentric section of said control disc, and the rotation of said control disc is driven in part by dragging torque generated between said engagement disc and said control disc.

9. The variable valve mechanism according to claim 8, wherein the first engine speed is slower than the second engine speed.

10. The variable valve mechanism according to claim 8, wherein the first engine speed is faster than the second engine speed.

* * * * *